US006767179B2

(12) United States Patent
Kusagaya et al.

(10) Patent No.: US 6,767,179 B2
(45) Date of Patent: Jul. 27, 2004

(54) IMPELLER AND TURBINE TYPE FUEL PUMP

(75) Inventors: Katsuhiko Kusagaya, Kariya (JP); Yoshihiko Ito, Nisshin (JP); Motoya Ito, Hekinan (JP); Yukio Mori, Nagoya (JP); Masatoshi Takagi, Takahama (JP); Koji Maruyama, Kariya (JP); Eiji Iwanari, Chiryu (JP)

(73) Assignee: Denso Corporation (JP)

( * ) Notice: Subject to any disclaimer, the term of this patent is extended or adjusted under 35 U.S.C. 154(b) by 76 days.

(21) Appl. No.: 10/207,013

(22) Filed: Jul. 30, 2002

(65) Prior Publication Data

US 2003/0026686 A1 Feb. 6, 2003

(30) Foreign Application Priority Data

| | | |
|---|---|---|
| Jul. 31, 2001 | (JP) | 2001-232739 |
| Jul. 31, 2001 | (JP) | 2001-232746 |
| Mar. 15, 2002 | (JP) | 2002-073105 |
| Apr. 30, 2002 | (JP) | 2002-128085 |

(51) Int. Cl.[7] ..... F04D 5/00
(52) U.S. Cl. ..... 415/55.1; 416/228
(58) Field of Search ..... 415/55.1–7; 416/228, 416/237, 197 B

(56) References Cited

U.S. PATENT DOCUMENTS

| | | | | |
|---|---|---|---|---|
| 4,334,821 A | * | 6/1982 | Sixsmith et al. | 415/53 T |
| 5,265,996 A | * | 11/1993 | Westhoff et al. | 415/52.1 |
| 5,265,997 A | * | 11/1993 | Tuckey | 415/55.1 |
| 5,328,325 A | | 7/1994 | Strohl et al. | |
| 5,407,318 A | * | 4/1995 | Ito et al. | 415/55.1 |
| 5,642,981 A | * | 7/1997 | Kato et al. | 415/55.1 |
| 5,702,229 A | * | 12/1997 | Moss et al. | 415/55.4 |
| 5,904,468 A | | 5/1999 | Dobler et al. | |
| 6,019,570 A | | 2/2000 | Talaski | |
| 6,152,687 A | * | 11/2000 | Wilhelm et al. | 415/55.1 |
| 6,224,323 B1 | * | 5/2001 | Murase et al. | 415/55.1 |
| 6,270,310 B1 | * | 8/2001 | Gaston et al. | 415/55.1 |
| 6,299,406 B1 | * | 10/2001 | Yu et al. | 415/55.1 |
| 6,322,319 B1 | * | 11/2001 | Yoshioka | 415/55.1 |

FOREIGN PATENT DOCUMENTS

| | | |
|---|---|---|
| DE | 19615323 A1 | 10/1997 |
| DE | 19804680 A | 8/1999 |
| EP | 0931927 A1 | 7/1999 |
| EP | 1103726 A2 | 5/2001 |
| GB | 2036178 A | 6/1980 |
| JP | 6-272685 | 9/1994 |

OTHER PUBLICATIONS

Patent Abstracts of Japan, vol. 011, No. 016 (M–554), Jan. 16, 1987, & JP 61 190191 A (Automob Antipollut & SAF Res Center).

* cited by examiner

*Primary Examiner*—Edward K. Look
*Assistant Examiner*—J. M McAleenan
(74) *Attorney, Agent, or Firm*—Nixon & Vanderhye PC

(57) ABSTRACT

In a fuel pump having a high pump efficiency, an annular portion is formed on an outer periphery of an impeller to let one- and opposite-side blade grooves be independent of each other. Then, various improvements are made such as tilting front and rear wall surfaces of the blade grooves in a predetermined direction, forming one- and opposite-side blade grooves in a zigzag fashion, forming a guide surface in a communicating passage of a pump housing, and forming communicating holes in an impeller.

31 Claims, 16 Drawing Sheets

IMPELLER AND TURBINE TYPE FUEL PUMP

CROSS REFERENCE TO RELATED APPLICATION

This application is based upon and claims the benefit of priority of Japanese Patent Applications No. 2001-232739 filed on Jul. 31, 2001, No. 2001-232746 filed on Jul. 31, 2001, No. 2002-73105 filed on Mar. 15, 2002 and No. 2002-128085 filed on Apr. 30, 2002, the contents of which are incorporated herein by reference.

BACKGROUND OF THE INVENTION

1. Field of the Invention

The present invention relates to an impeller for feeding fuel under pressure from the interior of a fuel tank to fuel injection system in a vehicle, as well as a turbine type fuel pump which includes the impeller.

2. Description of Related Art

In a vehicle such as an automobile there sometimes is used a turbine type fuel pump for feeding fuel under pressure from the interior of a fuel tank to a fuel injection system. The turbine type fuel pump (also called "Wesco pump") usually includes an impeller of a disc shape having on its outer periphery surface a plurality of blades and blade grooves, a pump housing which houses the impeller therein rotatably, the pump housing having a C-shaped pump channel communicating with the blade grooves, and a motor for driving the impeller.

The fuel pump is required to exhibit a high pump efficiency. For satisfying this requirement it is necessary that ① fuel should flow smoothly from the pump channel into the blade grooves of the impeller and flow out smoothly from the blade grooves to the pump channel, ② there should occur neither stagnation nor collision between fuel flowing out from one-side blade grooves and fuel flowing out from opposite-side blade grooves, ③ a larger amount of fuel should rotate within the blade grooves and side grooves, ④ pulsation of fuel should not occur at terminal end portions of the side grooves, and ⑤ characteristics (shape and size) of the blade grooves should be capable of being determined while coming to attach importance to the increase of the pressure of fuel.

For the purpose of improving the pump efficiency, a fuel pump disclosed in JP-A No. Hei6-272685 (first conventional example) includes an impeller wherein front wall surfaces of blade grooves in a rotational direction are inclined. As shown in FIGS. 25 and 26, blades 304 and blade grooves 306 are formed alternately in a circumferential direction on both sides of a partition wall 302 of an impeller 300, and a C-shaped pump channel 312 which includes a pair of side grooves 311 is formed in a pump housing 310. The impeller 300 is adapted to rotate in x direction within the pump housing 310.

Front wall surfaces 307 of the blade grooves 306 are inclined to a side (rear side) opposite to the rotational direction x with respect to a plane P which is perpendicular to a side face 301 of the impeller 300, whereby it is intended to cause vortex flows to flow smoothly near the front wall surfaces 307, eliminate the occurrence of a negative pressure thereabouts and thereby prevent the occurrence of a turbulent flow.

In a fuel pump disclosed in JP-A No. Hei 6-272685 (second conventional example), as shown in FIG. 27, blades 321 and blade grooves 322 are formed alternately on both sides of a partition wall 323 of an impeller 320. An outside diameter of an outer periphery surface 323*a* of the partition wall 323 is equal to an outside diameter of an outer periphery surface 321*a* of each blade 321. A pump housing 325 has a C-shaped pump channel, the pump channel comprising right and left side grooves 326 and a communicating groove 327 for communication between both side grooves.

As indicated with arrows, fuel enters the inner periphery side of blade grooves 322 from the side grooves 326, then flows radially outwards through the blade grooves 322 while being guided by both side faces 323*b* of the partition wall 323 under the action of a centrifugal force based on rotation of the impeller 320, whereby the fuel pressure is increased. The fuel thus increased its pressure then flows out to the communicating groove 327 and side grooves 326 from the outer periphery side of the blade grooves 322 and again enters blade grooves 322 located on the back side.

In a fuel pump shown in FIG. 28 (third conventional example), an outside diameter of an outer periphery surface 343*a* of a partition wall 343 in an impeller 340 is smaller than that of an outer periphery surface 341*a* of each blade 341, and the width of the partition wall 343 is very small at the outer periphery surface 343*a*. As a result, right and left blade grooves 342 are communicated with each other through an annular space 344 formed on the outer periphery side of the partition wall 343. A pump channel of a pump housing 345 comprises right and left side grooves 346 and a communicating path 347 which provides communication between both side grooves 346.

Fuel which has entered the inner periphery side of blade grooves 342 from the side grooves 346 flows radially outwards through the blade grooves while being guided by both side faces 343*b* of the partition wall 343 under the action of a centrifugal force based on rotation of the impeller 340, whereby its pressure is increased. The fuel thus increased its pressure flows out to the annular space 344 and the communicating path 347 from the outer periphery side of the blade grooves 342 and again enters blade grooves 342 located on the back side.

In a fuel pump shown in FIG. 29 (fourth conventional example), the width of a guide surface 363*b* of a partition wall 363 in an impeller 360 i.e., the width of a bottom of each blade groove 362, increases gradually at an outermost periphery portion, and an annular portion 368 is formed on an outer periphery side of the partition wall 363 and blades 361. On the other hand, in a pump housing 365 is formed a C-shaped pump channel which includes right and left side grooves 366 and a communicating path 367 for communication between both side grooves 366.

In impeller and housing disclosed in Japanese Patent No. 2962828 (fifth conventional example), a communicating portion is not formed in the pump housing, but a communicating hole is formed in the impeller. More particularly, as shown in FIGS. 30 and 31, in one side face 401 on a discharge side of an impeller 400 and in an opposite side face 406 on a suction side of the impeller there are formed plural blade grooves 402 and 407 spacedly in a circumferential direction. Between adjacent blade grooves 402 and 407 are formed blades 403 and 408, and an annular portion 411 is formed along an outer periphery edge of the impeller 400.

The blade grooves 402 in one side face 401 and the blade grooves 407 in the opposite side face 406 have arc shaped bottoms 404 and 409 respectively. The groove bottoms 404 and 409 intersect each other at an axially intermediate portion, whereby a communicating hole 413 extending axially through the impeller from one side face 401 to the opposite side face 406 is formed radially outwards of the intersecting portion indicated at 405. The blade grooves 402 and 407 are in communication with each other through the communicating hole 413.

In FIG. 30, a housing 415 comprises a discharge-side housing 416, a suction-side housing 421, and an outer housing 426. One side groove 417 is formed in an inner surface of the discharge-side housing 416 at a position close to the outer periphery side. The one side groove 417 extends in C shape from a start end portion up to a terminal end portion (neither shown) which is communicated with a fuel discharge port.

Likewise, an opposite side groove 422 is formed in an inner surface of the suction-side housing 421 at a position close to the outer periphery side. The opposite side groove 422 extends from a start end portion communicated with a fuel suction port up to a terminal end portion (neither shown). The outer housing 426 covers outer periphery surfaces of both discharge-side housing 416 and suction-side housing 421.

Fuel flows into the blade groove 407 from a start end portion of the suction-side housing 421, then passes through the communicating hole 413 in the impeller and flows to a start end portion of the opposite-side blade groove 402 and a start end portion of the discharge-side housing 416. While the impeller 400 is rotating, its blades 403 and 408 imparts a circumferential push-out force to the fuel which has entered the blade grooves 402 and 407 and the resulting centrifugal force causes the fuel to flow radially outwards along the groove bottoms 404 and 409.

Thereafter, the fuel strikes against the annular portion 411 of the impeller 400 and flows axially outwards, then is guided by the side grooves 417 and 422 and returns to the blade grooves 402 and 407. While repeating the circulation between the blade grooves 402, 407 and the side grooves 417, 422, the fuel flows spirally from the start to the terminal end portion through the pump channel. The pressure-increased fuel which has reached the terminal end portion of the suction-side housing 421 flows through the communicating hole 413 into the terminal end portion of the discharge-side housing 416 and is discharged from the fuel discharge port.

The construction of the blade groove 306 in the first conventional example shown in FIGS. 25 and 26 cannot be said satisfactory for the improvement of pump efficiency. In more particular terms, radially in FIG. 25, as indicated with arrow y, fuel flows into the blade groove 306 from the inner periphery side thereof, then flows radially outwards while being guided by a side face 303 of the partition wall 302, and flows out from the outer periphery side of the blade groove 306. In the circumferential direction, as indicated with arrow z in FIG. 26, fuel flows into the blade groove 306 from the front wall surface 307 side and flows out from a rear wall surface 308 side.

Since the front wall surface 307 of the blade groove 306, i.e., the rear wall surface of the blade 304, is inclined backward with respect to the rotational direction x, the admission of fuel into the blade groove 306 becomes smooth to some extent. However, since the rear wall surface 308 of the blade groove 306, i.e., the front wall surface of the blade 304, is parallel to the plane P, the efflux of fuel from the blade groove 306 cannot be said satisfactorily smooth. Moreover, there occurs stagnation between fuel portions flowing out into the pump channel from both sides of the partition wall 302, so that the flow rate of circulating fuel is apt to decrease. Further, as shown in FIG. 26, the axial length of the blade groove 306 is short and so it is difficult to consider that a large amount of fuel circulates.

In the second conventional example shown in FIG. 27, fuel present in the blade groove 322 flows radially outwards while being guided by the guide surface 323*b* of the partition wall 323*b*, then strikes against an end portion of the communicating groove 327 and its flowing direction is changed to a transversely outward direction. Thus, the fuel present in an intermediate portion of the communicating groove 327, i.e., the fuel present outside the outer periphery edge 323*a* of the partition wall 323, is apt to stagnate. Consequently, the amount of fuel circulating between the blade groove 322 and the pump channels 326, 326 is apt to decrease.

In the third conventional example shown in FIG. 28, the fuel present in the blade groove 342 flows radially outwards while being guided by the guide surface 343*b* of the partition wall 343 and strikes against an intermediate portion of the communicating path 347, then its flowing direction is changed substantially to both transversely outward directions. Consequently, the flow velocity of fuel is apt to decrease.

As to the above inconveniences involved in the first to third conventional examples, one cause is presumed to reside in that the impellers 300, 320 and 340 are not provided with an annular portion along the outer peripheries of the partition walls 302, 323 and 343.

According to the fourth conventional example shown in FIG. 29, the width of the partition wall 363 increases gradually toward the outermost periphery, but not to a sufficient extent. Besides, no special consideration is given for preventing the pulsation of fuel and for increasing the flow rate of rotating fuel.

The blade grooves 322 of the impeller 320, the blade grooves 341 of the impeller 340, and the blade grooves 362 of the impeller 360 in the second, third, and fourth conventional examples, respectively, are short in their axial lengths and it is difficult to consider that a large amount of fuel circulates.

In the fifth conventional example shown in FIGS. 30 and 31, it is desirable that characteristics (shape and size) of the blade grooves 402 and 407 be determined while coming to attach importance to an optimum pressure increase of fuel. Therefore, in selecting characteristics of the blade grooves 402 and 407, it is necessary that characteristics of the communicating hole 413 be taken into account. For example, although increasing the blade grooves 402 and 407 is effective in point of increasing the fuel pressure, the communicating hole 413 becomes smaller and a smooth flowing of fuel between the discharge-side housing 416 and the suction-side housing 421 is obstructed. That is, the presence of the communicating hole 413 restricts a free design of characteristics of the blade grooves 402 and 407.

SUMMARY OF THE INVENTION

An object of the present invention is to provide an impeller and a turbine type fuel pump superior in pump efficiency by forming an annular portion on an outer periphery side of the impeller to let one- and opposite-side blade grooves independent and by subsequently improving the impeller and/or pump housing.

More specifically, a first aspect of the invention aims at providing a turbine type fuel pump wherein fuel flows smoothly into blade grooves from a pump channel and flows out smoothly from the blade grooves to the pump channel, and the flow of fuel is accelerated within the blade grooves, thereby permitting the flow of fuel in the pump channel to be prevented from stagnation.

A second aspect of the invention aims at providing a turbine type fuel pump capable to prevent stagnation and collision of fuel flowing out from both-side blade grooves, allowing large amount of fuel circulate from the interiors of blade grooves and side grooves, and preventing pulsation of fuel at a terminal end portion of a pump channel.

A third aspect of the invention aims at providing an impeller and a fuel pump both capable to determine characteristics of blade grooves which can realize a higher pump efficiency independently of characteristics of communicating means and capable to prevent movement of the impeller within a pump housing which is caused by imbalance of pressure.

A fourth aspect of the invention aims at providing an impeller and a fuel pump capable to determine characteristics of blade grooves which can realize a higher pump efficiency independently of characteristics of communicating means and permitting an increase in the amount of fuel circulating within the blade grooves.

In connection with the first aspect of the invention, the present inventors have become aware that the impairment of smooth fuel admission into the blade grooves is caused by separation of fuel flow from the inner surface side of the rear wall surface of each blade, that the flow velocity of fuel in each blade groove is influenced by the width (circumferential length) of the blade groove on each of side face and a transversely central side of the impeller, that a vigorous efflux of fuel from each blade groove depends on the shape of an outer periphery side of the front wall surface, and that the stagnation of fuel flow can be prevented by increasing the width of the impeller at the outermost periphery. The present inventors have also taken notice of easiness in molding of the impeller. If the shapes of blade and blade groove are determined taking only pump efficiency into account, a certain shape of blade groove may render the removal of a die after molding impossible.

To achieve the first aspect of the invention, a turbine type fuel pump is provided with an impeller of a disc shape. The impeller has blades, blade grooves, and an annular portion formed on an outer periphery side of the blade grooves. The blades and the blade grooves are formed alternately in a circumferential direction on one side and an opposite side of an outer periphery portion of the impeller. Front and rear wall surfaces of each of the blade grooves are inclined backward with respect to a rotational direction. The fuel pump further has a pump housing which houses the impeller therein rotatably. The pump housing has generally C-shaped side grooves on one and the opposite side which side grooves are in communication with the blade grooves on one and the opposite side respectively, a fuel suction port communicating with a start end portion of the side groove on one side, and a fuel discharge port communicating with a terminal end portion of the side groove on the opposite side.

With the fuel pump mentioned above, by rotation of the impeller, fuel is circulated independently between the side grooves on one and the opposite side and the blade grooves on one and the opposite side to increase the fuel pressure.

According to this fuel pump, the front wall surfaces of the blades which are inclined backward with respect to the rotational direction of the impeller conduct the fuel smoothly into the blade grooves, while the rear wall surfaces inclined in the same direction impart vigor to the fuel flowing out from the blade grooves. Further, the annular portion prevents stagnation of the fuel flow.

It is preferable that an angle of inclination of the front wall surfaces of the blades on one and the opposite side at the outer periphery portion is larger than that of the rear wall surfaces of the blades at an inner periphery portion. As a result, the admission and efflux of fuel into and out of the blade grooves become smoother.

In addition, preferably, an angle of inclination of the rear wall surfaces of the blades on one and the opposite side at the outer peripheral portion is larger than an angle of inclination of the rear wall surfaces from a side face at the inner peripheral portion, the angle of inclination of the front wall surfaces of the blades on one and the opposite side at the outer periphery portion is larger than that of the front wall surfaces at the inner peripheral portion, and/or the angle of inclination of the front wall surfaces of the blades on one and the opposite side is larger than that of the rear wall surfaces of the blades at the outer periphery portion.

Further, it is preferable that an angle of inclination of the front wall surfaces of the blades on one and the opposite side at an inner peripheral portion is larger than that of the rear wall surfaces at the inner peripheral portion.

Furthermore, preferably, an angle of inclination of the front wall surfaces of the blades on one and the opposite side at the outer periphery portion is larger than an angle of inclination of the rear wall surfaces from a side face at the outer periphery portion, and an angle of inclination of the front wall surfaces of the blades at an inner periphery portion is lager than that of the rear wall surfaces at the inner periphery portion.

According to the fuel pumps mentioned above, the removal of the die after molding the impeller becomes easier.

To achieve the second aspect of the invention, a first turbine type fuel pump is provided with an impeller of a disc shape. The impeller has blades, blade grooves, and an annular portion formed on an outer periphery side of the blade grooves. The blades and the blade grooves are formed alternately in a circumferential direction on one side and an opposite side of an outer periphery portion of the impeller. Front and rear wall surfaces of each of the blade grooves are inclined backward with respect to a rotational direction. The fuel pump further has a pump housing which houses the impeller therein rotatably. The pump housing has generally C-shaped side grooves on one and the opposite side which side grooves are in communication with the blade grooves on one and the opposite side respectively, a fuel suction port communicating with a start end portion of the side groove on one side, a fuel discharge port communicating with a terminal end portion of the side groove on the opposite side, start end-side communicating portions for communication between the start end portion of the side groove on one side and a start end portion of the side groove on the opposite side, and terminal end-side communicating portions for communication between a terminal end portion of the side groove on one side and the terminal end portion of the side groove on the opposite side.

With the first turbine type fuel pump, by rotation of the impeller, fuel is circulated independently between the side grooves and the blade grooves on one and the opposite side to increase the fuel pressure.

According to this fuel pump, the annular portion of the impeller and the communicating portions of the pump housing avoid stagnation and collision of fuel in a pump channel.

It is preferable to make the fuel flow at the start and end portions smooth that the communicating portions in the start end portions on one and the opposite side and the communicating portions in the terminal end portions on one and the opposite side are formed axially on outer periphery sides of the start and terminal end portions.

Further, to prevent the pulsation at the terminal end portion, preferably, the communicating portion in the terminal end portion of the side groove on one side has an inclined guide surface inclined in a direction to guide fuel present within the side groove to the terminal end portion of the side groove on the opposite side.

A second turbine type fuel pump is provided with an impeller of a disc shape. The impeller has one-side blades and blade grooves formed alternately in a circumferential direction on one side face of an outer periphery portion of the impeller, opposite-side blades and blade grooves formed alternately in the circumferential direction on an opposite side face of the outer periphery portion and in a circumferentially displaced state with respect to the blades and blade grooves on one side, and an annular portion formed on an outer periphery side of the blade grooves on one and the opposite side. The fuel pump further has a pump housing which houses the impeller therein rotatably. The pump housing has generally C-shaped side grooves formed on one and the opposite side and communicating respectively with the blade grooves formed on one and the opposite side, a fuel suction port communicating with a start end portion of the side groove on one side, and a fuel discharge port communicating with a terminal end portion of the side groove on the opposite side.

With the second turbine type fuel pump, by rotation of the impeller, fuel is circulated independently between the side grooves on one and the opposite side and the blade grooves on one and the opposite side to increase the fuel pressure.

According to this fuel pump, the pulsation of pressure at a terminal end portion of a pump channel is prevented by the annular portion of the impeller and further by a zigzag arrangement of one- and opposite-side blade grooves.

It is preferable to make the flow of fuel in the blade grooves smooth that the blade grooves on one and the opposite side are inclined backward with respect to a rotational direction.

To prevent the stagnation and collision of fuel, the blade grooves on one and the opposite side are, preferably, gradually decreased their spacings as a transversely central part is approached from side faces of the impeller.

To achieve the third aspect of the invention, a first impeller having a disc shape. An outer periphery portion of the impeller has a plurality of one-side blade grooves formed spacedly in a circumferential direction on one side face of the outer periphery portion, a plurality of opposite-side blade grooves formed spacedly in the circumferential direction on an opposite side face of the outer periphery portion and isolated from the one-side blade grooves, and a plurality of communicating holes extending through portions from the one to the opposite side face which portions are deviated radially inwards or outwards from the one- and opposite-side blade grooves.

According to this impeller, the one- and opposite-side blade grooves are not formed with communicating holes for allowing fuel to flow from the suction side to the discharge side. Therefore, it is possible to select such size and shape of one- and opposite-side blade grooves as can realize an optimum increase of fuel pressure independently of the selection of shape, etc. of communicating holes.

A second impeller has a disc shape. An outer periphery portion of the impeller has a plurality of one-side blades and blade grooves formed alternately in a circumferential direction on one side face of the outer periphery portion, a plurality of opposite-side blades and blade grooves formed alternately in the circumferential direction on an opposite side face of the outer periphery portion and isolated from the one-side blade grooves, an outer annular portion positioned on an outer periphery side of the one- and opposite-side blades, and a plurality of communicating holes formed in and extending through portions from the one to the opposite side face which portions are deviated radially inwards or outwards from the one- and opposite-side blade grooves.

According to this impeller, a partition wall portion for partitioning between one- and opposite-side blade grooves is not formed with communicating holes for the flow of fuel from the suction side to the discharge side. Therefore, characteristics of the outer annular portion and the one- and opposite-side blades can be selected so as to select such size and shape of the one- and opposite-side blade grooves as can realize an optimum increase of fuel pressure independently of the selection of shape, etc. of communicating holes.

It is preferable to increase the pressure of fuel efficiently with minimum pressure pulsation that the plural one-side blade grooves and the plural opposite-side blade grooves are displaced from each other in the circumferential direction.

Preferably, the plural communicating holes are formed radially inside the plural one-side blade grooves and the plural opposite-side blade grooves. Since the one- and opposite-side blade grooves are formed radially near the outer periphery and the radius of gyration becomes large, the pressure of fuel is increased effectively.

If the plural communicating holes are displaced in the circumferential direction from radial extension lines of the plural one- and opposite-side blade grooves, the one- and opposite-side blade grooves, which are displaced (in a zigzag fashion) in the circumferential direction, are communicated with each other through communicating holes.

The number of the communicating holes may be equal to or smaller than the number of the one- and opposite-side blade grooves. The same number of communicating holes as the number of blade grooves provide communication between one- and opposite-side blade grooves and a smaller number of communicating holes than the number of blade grooves provide communication between a portion of one-side blade grooves and a portion of opposite-side blade grooves.

A plurality of one-side shallow grooves and a plurality of opposite-side shallow grooves may be formed to communicate with the plural one- and opposite-side blade grooves and the plural communicating holes. In this case, the one- and opposite-side shallow grooves provide communication between one- and opposite-side blade grooves even in the case where one- and opposite-side blade grooves are in opposition to the communicating holes in the start and terminal end portions.

A plurality of axially projecting one-side projections and a plurality of axially projecting opposite-side projections may be formed between the plural one- and opposite-side blade grooves and the communicating holes so that a certain wall thickness is ensured between the one- and opposite-side blade grooves and the communicating holes and this thick-walled portion is difficult to undergo breakage, etc.

A plurality of one-side shallow grooves and a plurality of opposite-side shallow grooves may be formed in the plural one- and opposite-side projections to provide communication between the plural one- and opposite-side blade grooves and the communicating holes. Even where one- and opposite-side blade grooves are not in opposition to the communicating holes in the start and terminal end portions, one- and opposite-side shallow grooves formed in the one- and opposite-side projections provide communication between the one- and opposite-side blade grooves.

If the number of the one- and opposite-side shallow grooves is equal to or smaller than the number of the communicating holes, the same number of one- and opposite-side shallow grooves as the number of communicating holes provide communication between the communicating holes and the blade grooves and a smaller number of one- and opposite-side shallow grooves than the number of communicating holes provide communication between a portion of communicating holes and a portion of blade grooves.

The plural one- and opposite-side shallow grooves may be displaced in the circumferential direction from radial extension lines of the plural one- and opposite-side blade grooves and also from radial extension lines of the communicating holes so that one- and opposite-side shallow grooves provide communication between one- and opposite-side blade grooves formed in a zigzag fashion together with the communicating holes.

To achieve the third aspect of the invention, a turbine type fuel pump comprises an impeller having a disc portion and an outer periphery portion. The outer periphery portion includes a plurality of one-side blade grooves formed spacedly in a circumferential direction on one side of the outer periphery portion, a plurality of opposite-side blade grooves formed spacedly in the circumferential direction on an opposite side face of the outer periphery portion and isolated from the one-side blade grooves, and a plurality of communicating holes extending through portions from the one side face to the opposite side face which portions are deviated radially inwards or outwards from the one- and opposite-side blade grooves of the outer periphery portion. The fuel pump further comprises a pump housing which houses the impeller therein rotatably, the pump housing has a generally C-shaped one-side side groove and a generally C-shaped opposite-side side groove. The generally C-shaped one-side side groove extends from a one-side start end portion up to a one-side terminal end portion. The one-side start end portion is provided with a first communicating portion opposed to one-side openings of the plural communicating holes and is in communication with a fuel suction port. The one-side terminal end portion is provided with a second communicating portion opposed to the one-side openings. The generally C-shaped opposite-side side grooves extends from an opposite-side start end portion up to an opposite-side terminal end portion. The opposite-side start end portion is provided with a third communicating portion opposed to opposite-side openings of the plural communicating hole. The opposite-side terminal end portion is provided with a fourth communicating portion opposed to the opposite-side openings and is in communication with a fuel discharge port. The fuel pump further comprises a motor for rotating the impeller within the pump housing.

With the fuel pump mentioned above, a portion of fuel which has entered the first communicating portion flows to the third communicating portion through the communicating holes, fuel flows from the one- and opposite-side start end portions to the one- and opposite-side terminal end portions, and fuel in the second communicating portion which fuel has been increased its pressure flows to the fourth communicating portion through the communicating holes.

In this fuel pump, a portion of fuel which has entered the first communicating portion flows to the third communicating portion through communicating holes formed in the impeller. Consequently, the fuel flows spirally from one- and opposite-side start end portions to one- and opposite-side terminal end portions while circulating between one-side blade grooves and one-side side groove and between opposite-side blade grooves and opposite-side side groove. The fuel in the second communicating portion, whose pressure has been increased, flows to the fourth communicating portion through communicating holes formed in the impeller. As a result, there is attained a high pump pressure and the application of a radial force to the impeller, which is caused by the pressure of fuel flowing in the communicating holes, is prevented.

To make the formation of one- and opposite-side side grooves easier, it is preferable that the pump housing comprises a first housing located on the suction side and having a lid shape and a second housing located on the discharge side and having a container shape.

Preferably, the first and second communicating portions in the first housing are formed radially inside of the one-side start end portion and terminal end portion and have a radial length corresponding to the plural communicating holes.

Further, the third and fourth communicating portions in the second housing are formed radially inside of the opposite-side start end portion and terminal end portion and have a radial length corresponding to the plural communicating holes. In this case, the communicating portions in one- and opposite-side start and terminal end portions are opposed to one- and opposite-side openings of communicating holes formed radially inside of one- and opposite-side blade grooves in the impeller, whereby the flow of fuel from the opposite-side side groove to the one-side side groove is promoted.

To achieve the fourth aspect of the invention, a first impeller has a disc shape, and an outer periphery portion thereof includes a plurality of one-side blades and blade grooves formed alternately in a circumferential direction on one side face of the outer periphery portion, a plurality of opposite-side blades and brade grooves formed alternately in the circumferential direction on an opposite side face of the outer periphery portion, and a plurality of communicating holes extending through portions from the one to the opposite side face which portions are deviated radially inwards or outwards from the one- and opposite-side blade grooves of the outer periphery portion.

With the first impeller mentioned above, axial tip end portions of the one- and opposite-side blade grooves extend beyond an axially intermediate portion of the impeller.

Further, a second impeller has a disc shape, and an outer periphery portion thereof includes a plurality of one-side blades and blade grooves formed alternately in a circumferential direction on one side face of the outer periphery portion, a plurality of opposite-side blades and blade grooves formed alternately in the circumferential direction on an opposite side face of the outer periphery portion, and an annular portion positioned on an outer periphery side of the one- and opposite-side blades. The one- and opposite-side blade grooves are axially overlapped each other in a section including an axis of the impeller.

According to these impellers, such characteristics of blade grooves as can realize higher pump efficiency can be determined independently of characteristics of the communicating portions. Besides, it is possible to ensure such a blade groove shape as increases the momentum of fuel in the blade grooves.

If front and rear wall surfaces of the one- and opposite-side blade grooves are inclined backward with respect to a rotational direction, the admission of fuel into the blade grooves becomes smooth and vigor is imparted to the fuel flow at the time of efflux.

Further, if the one- and opposite-side blade grooves are displaced from each other in the circumferential direction, the fuel pressure can be increased effectively with minimum pulsation of pressure.

Furthermore, if a plurality of communicating holes extending through the outer periphery portion from the one side face to the opposite side face are formed, characteristics of the blade grooves can be determined independently of characteristics of the communicating holes.

The plural communicating holes may be deviated in the circumferential direction from radial extension lines of the one- and opposite-side blade grooves so that the one- and opposite-side blade grooves arranged in a zigzag fashion can be communicated with each other in a satisfactory manner.

Moreover, if the annular portion is formed with a plurality of one-side shallow grooves and a plurality of opposite-side shallow grooves to provide communication between the plural one- and opposite-side blade grooves and plural communicating holes, the one- and opposite-side blade grooves are communicated with each other through shallow grooves even if they are not opposed to the communicating holes.

Another turbine type fuel pump comprises an impeller of a disc shape, an outer periphery portion of the impeller including a plurality of one-side blades and blade grooves formed alternately in a circumferential direction on one side face of the outer periphery portion, a plurality of opposite-side blade grooves formed alternately in the circumferential direction on an opposite side face of the outer periphery portion, and a plurality of communicating holes extending through portions from the one to the opposite side face which portions are deviated radially inwards or outwards from the one- and opposite-side blade grooves of the outer peripheral portion, axial tip end portions of the one- and opposite-side blade grooves extending beyond an axially intermediate portion of the impeller. The fuel pump further comprises a pump housing which houses the impeller therein rotatably, the pump housing having generally C-shaped one- and opposite-side side grooves corresponding to the one- and opposite-side blade grooves respectively, a fuel suction port communicating with a start end portion of the one-side side groove, and a fuel discharge port communicating with a terminal end portion of the opposite-side side groove.

With the fuel pump mentioned above, by rotation of the impeller, fuel is circulated between the side grooves and the one- and opposite-side blade grooves to increase the fuel pressure. According to this fuel pump, such characteristics of the blade grooves as can realize higher pump efficiency can be determined independently from characteristics of the communicating portions. Besides, it is possible to ensure such a blade groove shape as increases the momentum of fuel in the blade grooves.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

<An Impeller>

Figure 1:
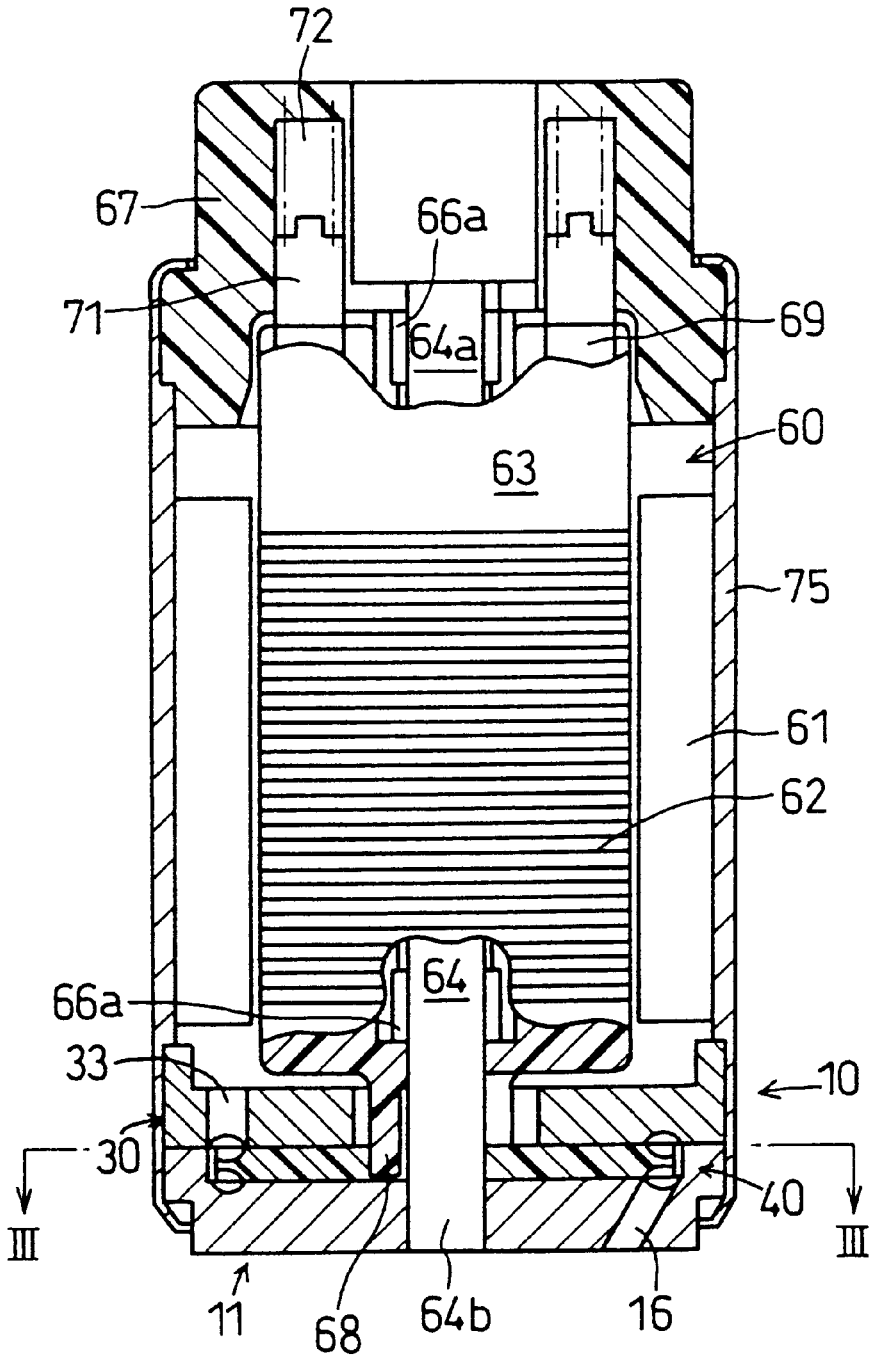
FIG. 1 is a vertical sectional view showing a turbine type fuel pump according to a first embodiment of the invention.

An impeller comprises a disc portion and an annular outer periphery portion located on an outer periphery side of the disc portion. The disc portion is a portion which is guided by a pump housing, while the outer periphery portion is a portion which, in cooperation with the pump housing, causes the fuel pressure to increase while allowing the fuel to circulate. The outer periphery portion may include an annular portion, a partition wall portion, and plural blades and blade grooves.

① Annular Portion, Partition Wall Portion

The annular portion is positioned radially outside, has a predetermined width in the axial direction, and extends in the circumferential direction. The partition wall portion has a predetermined axial thickness at an axially intermediate portion of the impeller and extends in the circumferential direction. It is desirable that the thickness (axial size) of the partition wall portion first decrease and then increase radially outwards.

② Blade Groove

Plural blade grooves formed on one and opposite side of the partition wall portion are fuel inflow and outflow spaces and are formed at predetermined pitches in the circumferential direction. The number of one-side blade grooves and that of opposite-side blade grooves may each be set at, for example, 30 to 70 and the number of row may be one or two.

If one- and opposite-side blade grooves are axially opposed to each other, the pressure of fuel present in a one-side side groove and that of fuel present in an opposite-side side groove are increased equally and there will be obtained a good pressure balance between the two. On the other hand, if the one- and opposite-side blade grooves are displaced (zigzagged) from each other in the circumferential direction, a pressure variation in the one-side side groove and that in the opposite-side side groove will be out of phase and it is possible to diminish a pressure variation at a confluence. A displacement quantity in the circumferential direction can be set at, typically, half of the groove forming pitch.

It is optional whether front and rear wall surfaces of the one- and opposite-side blade grooves are to be perpendicular to the one- and opposite side face of the impeller or are to be inclined backward in the rotational direction, namely, in such a manner that the inner side is backward in the rotational direction with respect to the inlet side. The width (circumferential length) of one- and opposite-side blade grooves may be uniform throughout the overall length or may change gradually from side faces toward an axially intermediate portion. A sectional shape in the axial direction (depth direction) may be, for example, semi-circular or a shape closely similar thereto.

It is optional whether axial tip end portions (innermost portions) of one- and opposite-side blade grooves extend up to this side from an axially intermediate portion of the impeller, or up to the intermediate portion, or extend beyond the intermediate portion. Where the axial tip end portions extend beyond the intermediate portion, both blade grooves overlap in a section including the axis of the impeller.

③ Blade

Plural one- and opposite-side blades impart a circumferential force to the fuel which has entered one- and opposite-side blade grooves. The shape of one- and opposite-side blades are associated with the shape of one- and opposite-side blade grooves. One- and opposite-side blades are formed at predetermined pitches on one and opposite sides, respectively, of the partition wall, extend between inner and outer annular portions, and partition the one- and opposite-side blade grooves together with the outer periphery surface of the inner annular portion and the inner peripheral surface of the outer annular portion.

An inclination angle of a front wall surface of each blade from a side face of the outer periphery portion is larger than 50° and may be selected preferably in the range of 60° to 70°. On the other hand, an inclination angle of a rear wall surface there of is smaller than 50° and may be selected preferably in the range of 30° to 40°. Further, an inclination angle of the front wall surface from a side face of the inner periphery portion and that of the rear wall surface from a side face of the outer periphery portion may be selected in the ranges of 50° to 60° and 35° to 50°, respectively.

④ Communicating Hole

Plural communicating holes extend through the impeller from one to the opposite side face, permitting the admission of fuel from a first communicating portion on the suction side to a third communicating portion on the discharge side and the admission of fuel from a second communicating portion on the suction side to a fourth communicating portion on the discharge side. Plural communicating holes may be formed a little away from the one- and opposite-side blade grooves radially inwards or may be formed inside the one- and opposite-side blade grooves so as to leave no space. In the former case, a projection which projects a little axially is formed between each blade groove and the associated communicating hole.

The number of communicating holes is determined in consideration of pressure loss in fuel suction and discharge as well as productivity and is equal to or smaller than the number of one- and opposite-side blade grooves. A side shape (width and height) of the communicating holes is determined also taking into account pressure loss in fuel suction and discharge as well as productivity and it may be rectangular or circular. Both width and height may be uniform throughout the overall length.

⑤ Projection, Shallow Groove

Plural one- and opposite-side shallow grooves provide communication between plural one- and opposite-side blade grooves and plural communicating holes. For example, the shallow grooves are formed in projections between one- and opposite-side blade grooves and communicating holes and extend radially. The number of one- and opposite-side shallow grooves is equal to or smaller than the number of communicating holes. But since the shallow grooves function to provide communication between the blade grooves and the communicating holes, they are not formed in the circumferential portion where communicating holes are not formed. The number, width, and depth of one- and opposite-side shallow grooves are determined in consideration of pressure loss, etc. in the connection with communicating holes.

<Pump Housing>

A pump housing has generally C-shaped one- and opposite-side side grooves, a fuel suction port, a fuel discharge port, and an inner periphery surface. The pump housing comprises a first housing located on one side (suction side) of the impeller and a second housing on an opposite side (discharge side). The first and second housings may have substantially symmetric container shapes, or one may have a container shape and the other a lid shape.

One- and opposite-side side grooves are formed in the first and second housings, respectively. The one-side side groove extend from a one-side start end portion up to a one-side terminal end portion and is positioned sideways of the one-side blade grooves, while the opposite-side side groove extends from an opposite-side start end portion up to an opposite-side terminal end portion and is positioned sideways of the opposite-side blade grooves. The start end portion of the opposite-side side groove is communicated with the fuel suction port and the terminal end portion of the one-side side groove is communicated with the fuel discharge port. The start end portions of the one- and opposite-side side grooves, as well as the terminal end portions of the one- and opposite-side side grooves, are respectively communicated with each other through communicating paths formed in the pump housing or through communicating holes formed in the impeller.

Where the impeller is not provided with communication holes, the pump housing has a communicating passage formed axially on an outer periphery side of start and terminal end portions to provide communication between the start end portions of the one- and opposite-side side grooves and a communicating passage formed axially on the outer periphery side to provide communication between the terminal end portions of the one- and opposite-side side grooves.

Where the impeller is provided with communicating holes, the first to fourth communicating portions at the first and terminal end portions are formed on the inner periphery side of the start and terminal end portions in opposition to communicating holes. For example, the first and second communicating portions are formed radially inside of the one-side start and terminal end portions, while the third and fourth communicating portions are formed radially inside of the opposite-side start and terminal end portions.

Embodiments of the present invention will be described hereinafter with reference to the accompanying drawings.

<First Embodiment>

(Construction)

① Entire Construction

The whole of a turbine type fuel pump will now be described with reference to FIG. 1. A pump section 10 and a motor section 60 are axially installed side by side within a cylindrical pump housing 75. In the pump section 10, a pump casing 30 and a pump cover 11 are fixed to a lower end portion of the pump housing 75 and in the interior thereof is received an impeller 40 having alternate blades 45 and blade grooves 50. A fuel suction port 16 is formed in the pump cover 11 and a fuel discharge port 33 is formed in the pump casing 30. As to the pump section 10, a more detailed description will be given later.

In the motor section 60, an armature 62 is disposed concentrically on an inner periphery side of a cylindrical magnet 61. The armature 62 is formed by molding a core and a coil thereon with resin 63 and is supported on a fixed shaft 64 rotatably and slidably through bearings 66*a* and 66*b*, the fixed shaft 64 being fixed to a central part of the pump housing 75. A lower end portion 64*b* of the fixed shaft 64 is fixed to a central part of the pump cover 11, while an upper end portion 64*a* of the fixed shaft is inserted and fixed to a central part of a brush holder 67 which is fixed to an upper end portion of the pump housing 75.

At a lower end portion of the armature 62 are formed several projections 68, whose tip end portions extend through the impeller 40. Plural commutator segments 69 are provided radially on an upper end face of the armature 62. A pair of brushes 71 are held movably by the brush holder 67 and are urged into contact with the commutator segments 69 by means of a spring 72.

② Pump Section

Next, the pump section 10 will be described below in detail with reference to FIGS. 2 to 6.

Figure 2:
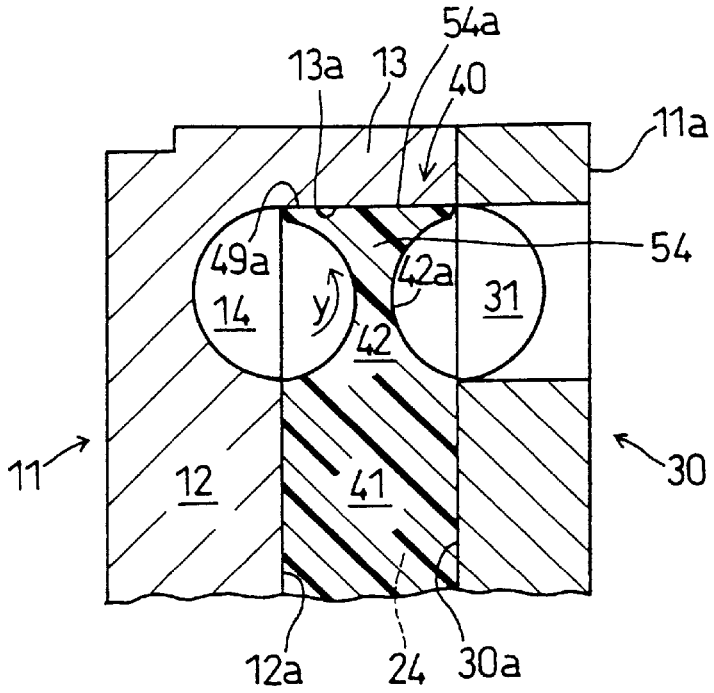
FIG. 2 is an enlarged view of a principal portion in FIG. 1.
Figure 3:
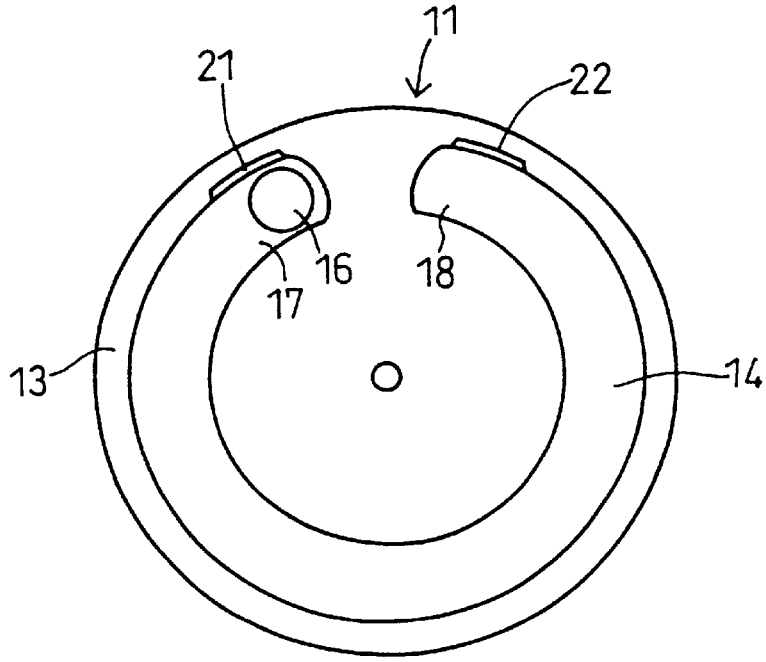
FIG. 3 is a sectional view taken on line III—III in FIG. 1.
Figure 4:
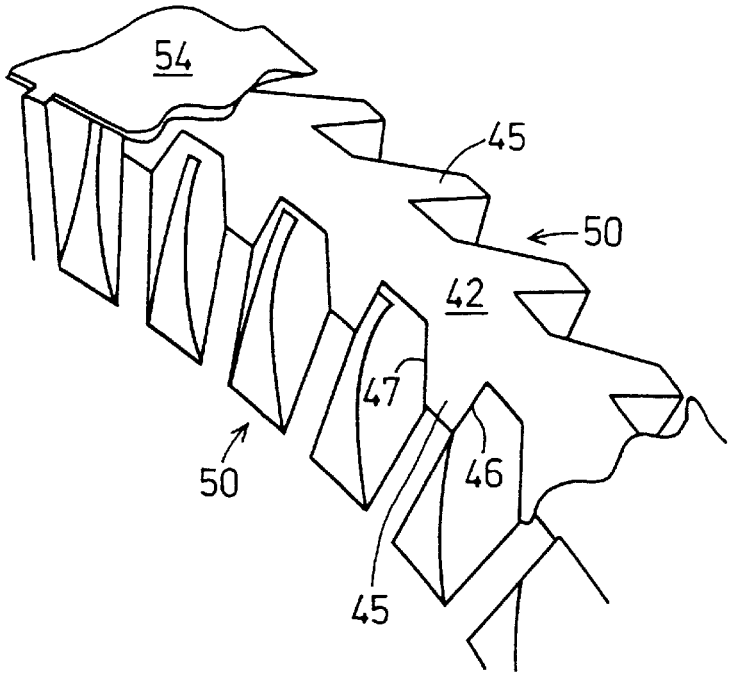
FIG. 4 is a partial perspective view of an impeller according to the first embodiment.
Figure 5:
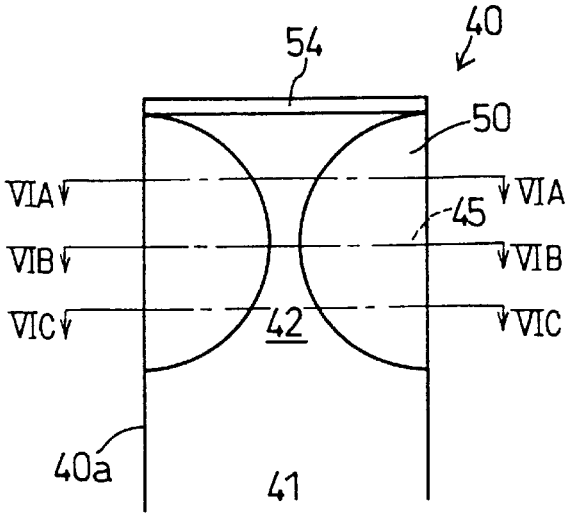
FIG. 5 is a vertical sectional view of the impeller in FIG. 4.

As shown in FIG. 2, on a side of an inner side face (right side face in FIG. 2) 11*a* of the pump cover 11 are formed a bottom wall 12 and a circumferential wall 13 therearound. A central portion of the bottom wall 12 forms a guide surface 12*a* of the impeller 40. As shown in FIGS. 2 and 3, a C-shaped side groove 14 of a semi-circular section is formed along an outer periphery portion on the inner side face 11*a*. The side groove 14 extends from a start end portion 17 communicating with a fuel suction port 16 (see FIG. 1) formed at a predetermined angle relative to the axis of the pump cover 11 up to a terminal end portion 18 communicating with a terminal end portion of a side groove 31 of the pump casing 30 which will be described later.

Communicating passages 21 and 22 are formed respectively on outer periphery sides of the start end portion 17 and terminal end portion 18 of the side groove 14 of the pump cover 11. The communicating passages 21 and 22 have predetermined length, width, and depth in the circumferential, axial, and radial directions, respectively, of the pump cover 11.

A central portion 30*a* of an inner side face (left side face in FIG. 2) of the pump casing 30 forms a guide surface of the impeller 40 and a C-shaped side groove 31 of a semi-circular section, which is the same shape as the side groove 14, is formed along an outer periphery portion on the inner side face. The side groove 31 extends from a start end portion to a terminal end portion communicated with the fuel discharge port 33 (see FIG. 1) which is formed in parallel with the axis of the pump casing 30.

The spacing between both side grooves 14 and 31 is equal to the width of a seal portion 49 of the impeller 40 to be described later and an inner periphery surface 13*a* of the inner periphery wall 13*a* is coincident with outer periphery edges of the side grooves 14 and 31. Though not shown, like communicating gaps are also formed on outer periphery sides of the start and terminal end portions of the side groove 31 in the pump casing 30 and are respectively in communication with the communicating passages 21 and 22 in the pump cover 11. A letter C-shaped pump channel is constituted by the side groove 31 and communicating gaps in the pump casing 30 and the side groove 14 and communicating passages 21, 22 in the pump cover 11.

Next, a description will be given of the impeller 40. As is apparent from FIGS. 2 and 4, the impeller 40 is made of resin and comprises a disc-like body 41, a ring-like partition wall 42 located around the disc-like body, blades 45 and blade grooves 50, which are formed on both right and left sides of the partition wall 42, and an annular portion 54 formed on an outer periphery side of the blades and blade grooves (the annular portion 54 is partly omitted in FIG. 4).

The width of the partition wall 42 first gradually decreases and then gradually increases radially outwards. On both right and left sides of the partition wall 42 are formed plural blades 45 and blade grooves 50 in a zigzag fashion. In the circumferential direction of the impeller 40 the left-hand (one-side) blades 45 correspond to the right-hand (opposite-side) blade grooves 50, while the left-hand blade grooves 50 correspond to the right-hand blades 45.

Figure 6C:
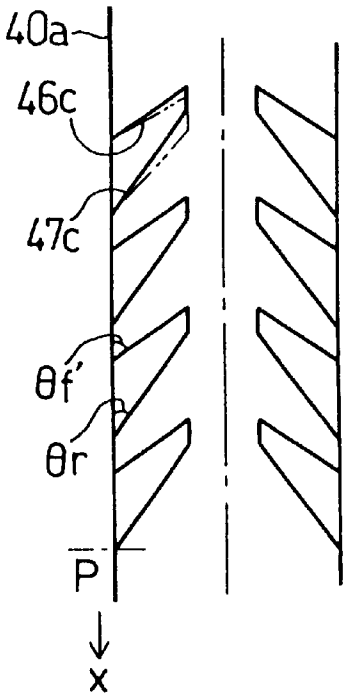
FIGS. 6A, 6B, and 6C are sectional views taken on lines VIA—VIA, VIB—VIB, and VIC—VIC, respectively, in FIG. 5.
Figure 6B:
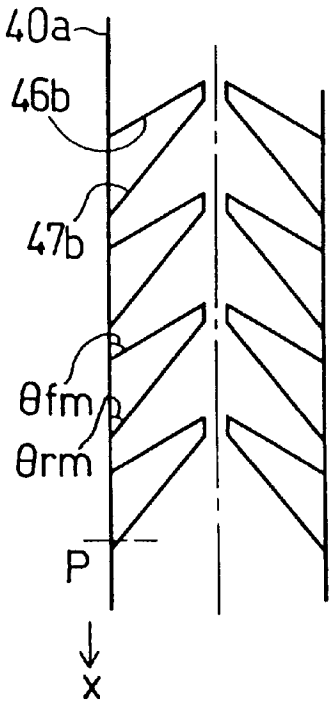
Figure 6A:
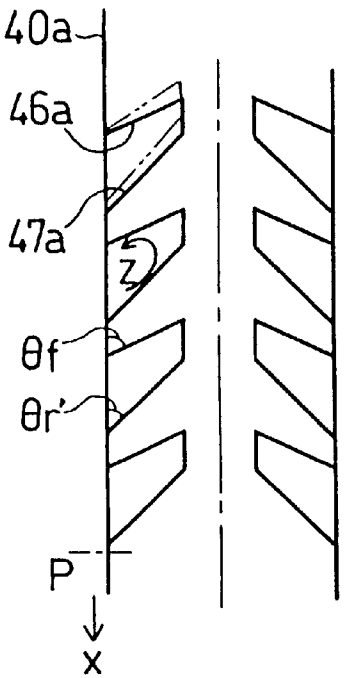

The blades 45 and blade grooves 50 of the impeller 40 are inclined to the side opposite to a rotational direction x with respect to a plane P (see FIG. 6) which is perpendicular to a side face 40*a*. The angle of a front wall surface 46 and a rear wall surface 47 of each blade 45 relative to the side face 40*a* differs at various radial portions. More specifically, as shown in FIGS. 6A, 6B and 6C, the angle of the front wall surface 46 relative to the side wall 40*a* is 65° (θf) at an outer periphery portion 46*a*, 60° (θfm) at an intermediate portion 46*b*, and 55° (θf') at an inner periphery portion 46*c*. On the other hand, the angle of the rear wall surface 47 of each blade 45 relative to the side surface 40*a* is 45° (θr') at an outer periphery portion 47*a*, 40° (θrm) at an intermediate portion, and 35° (θr) at an inner periphery portion.

Consequently, the angle θf of the outer periphery portion 46*a* of the front wall surface 46 is larger than the angle θr of the inner periphery portion 47*c* of the rear wall surface 47. The angle θr' of the outer periphery portion 47*a* of the rear wall surface 47 is larger than the angle θr of the inner periphery portion 47*a* of the rear wall surface 47. The angle of the outer periphery portion 46*a* of the front wall surface 46 is larger than the angle θf' of the inner periphery portion 46*c* of the front wall surface 46. Further, the angle θf' of the inner periphery portion 46*c* of the front wall surface 46 is larger than the angle θr' of the outer periphery portion 47*a* of the rear wall surface 47.

When viewed from a different angle, the outer periphery portion 46*a* of the front wall surface 46 makes an angle of 65° and the outer periphery portion 47*a* of the rear wall surface 47 makes an angle of 45°. The intermediate portion 46*b* of the front wall surface 46 makes an angle of 60° and the intermediate portion 47*b* of the rear wall surface 47 makes an angle of 40°. Further, the inner periphery surface 46*c* of the front wall surface 46 makes an angle of 55° and the inner periphery portion 47*c* of the rear wall surface 47 makes an angle of 35°. Thus, in all of the outer periphery portion, intermediate portion and inner periphery portion, the width (circumferential length) of each blade groove 50 decreases gradually toward a transversely central part from the side face 40*a* of the impeller 40.

An outer periphery surface 54*a* of the ring portion 54 is opposed to the inner periphery surface 13*a* of the inner periphery wall 13, and the partition wall 42 and the ring portion 54 isolate the left and right side grooves 14, 31 from each other. The body 41, the partition wall 42 and the right and left blades 45, and the ring portion 54 are integrally formed using a resin material.

(Function and Advantage)

In FIGS. 1 and 3, fuel is sucked into the start end portion 17 of the side groove 14 from the fuel suction port 16, then flows into the side groove 31 in the pump casing 30 through the communicating passage 21, etc. and further flows into the blade grooves 50 from the side grooves 14, 31.

The fuel present in each blade groove 50 undergoes a circumferential force from the blades 45 of the impeller 40 which rotates in the direction of arrow x in FIGS. 6A to 6C. As a result, in the radial direction, the fuel flows radially outwards while being guided by the side face 42*a* of the partition wall 42 and the ring portion 54 under the action of a centrifugal force as indicated with arrow y in FIG. 2. At this time, stagnation and collision of fuel portions present on both right and left sides are prevented by the ring portion 54. Further, with the zigzag arrangement of the blades 46 and blade grooves 50 formed in the impeller 40, the occurrence of pressure pulsation at the terminal end portion 18 of the pump channel, etc. is prevented.

Thereafter, the fuel is guided by an inner surface of the ring portion 54, is directed to both right and left sides, and flows into the left- and right-hand side grooves 14, 31. The fuel then flows radially inwards and axially inwards within the side grooves 14 and 31 and flows into the blade groove 50 from the inner periphery side of the blade groove which blade groove is located on the rear side in the circumferential direction.

In the circumferential direction, as indicated with arrow z in FIG. 6A, the fuel flows into the blade groove 50 from the rear wall surface 47 of the blade 50 and flows out from the front wall surface 46. In FIG. 6C which shows an inner periphery-side section, the rear wall surface 47 of the blade 45 is inclined in the direction opposite to the rotational direction x of the impeller 40, making a relatively small angle of 35° with respect to the plane P which is perpendicular to the side face 40*a*. Therefore, the fuel flowing into the blade groove 50 is prevented from being separated from the inner periphery portion 47*c* of the rear wall surface 47. Further, in FIG. 6A which shows an outer periphery-side section, the front wall surface 46 is inclined in the direction opposite to the rotational direction x of the impeller 40, making a relatively large angle of 65° with respect to the side face 40*a*. Consequently, a large push-out force is imparted to the fuel flowing out from the blade groove 50.

Figure 7:
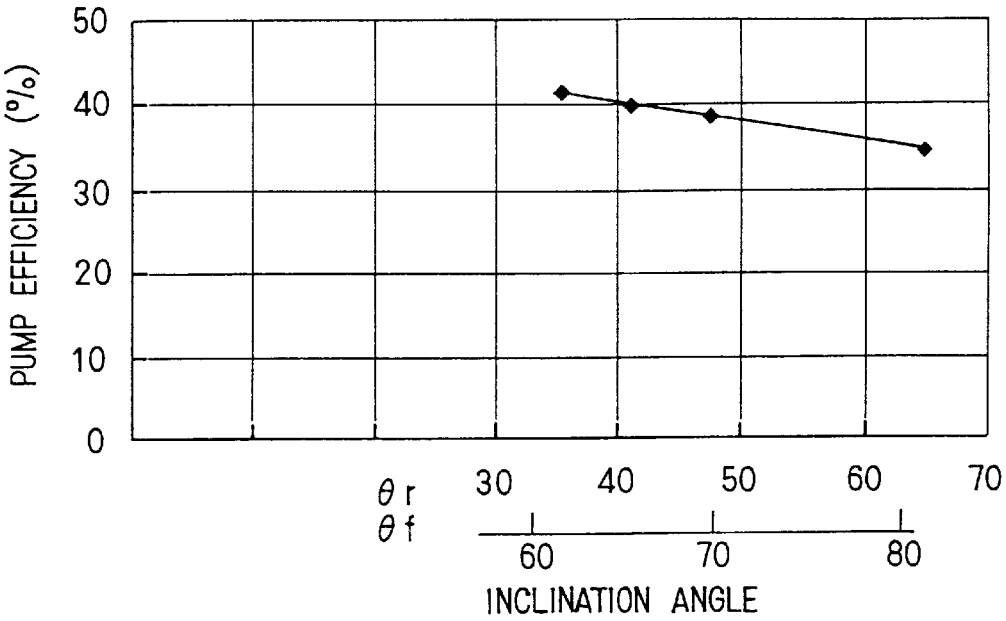
FIG. 7 is a graph showing a relation between an inclination angle of a wall surface of each blade and the pump efficiency.

As shown in FIG. 7, as the inclination angle θf of the outer periphery portion 46*a* of the front wall surface 46 and the inclination angle θr of the inner periphery portion 47*c* of the rear wall surface 47 become larger, the pump efficiency becomes higher. Therefore, selecting these inclination angles θf and θr as above is significant.

The inclination angle θf of the outer periphery portion 46*a* of the front wall surface 46 is larger than the inclination angle θr of the inner periphery portion 47*c* of the rear wall surface 47. Moreover, the inclination angle of the rear wall 47 increases gradually from the inner periphery portion 47*c* toward the outer periphery portion 47*a* and the inclination angle of the front wall surface 46 increases gradually from the inner periphery portion 46*c* toward the outer periphery portion 46*a* (see dash-double dot lines in FIGS. 6A and 6C). This takes into account the flow of fuel in each blade groove 50, whereby the flow of fuel in the blade groove 50 becomes smooth.

Further, in all of the outer periphery portion, intermediate portion and inner periphery portion of each blade 45 the width (circumferential length) of each blade groove 50 decreases gradually from the side face 40*a* of the impeller 40 toward the transversely central part. Therefore, as the fuel flows into the blade groove 50 along the rear wall surface 47, it is throttled by both rear and front wall surfaces 47, 46, so that the flow velocity increases and at this increased flow velocity the fuel flows out from the blade groove 50.

Thus, while circulating independently between the left and right blade grooves 50 and side grooves 14, 31, the fuel flows from the start end portion 17, etc. toward the terminal end portion 18, etc., during which period the fuel pressure is increased. The fuel which has been increased its pressure in the side groove 14 reaches the fuel discharge port 33 through the communicating passage 22 in the terminal end portion 18, etc. In this case, since the left and right blade grooves 50 have a depth reaching the vicinity of the transversely central part of the partition wall 42, the volume of each blade groove 50 increases and the circulatability of the fuel present therein is improved and the amount of fuel discharged increases.

Next, the following description is provided about the moldability of the impeller 40.

Figure 8:
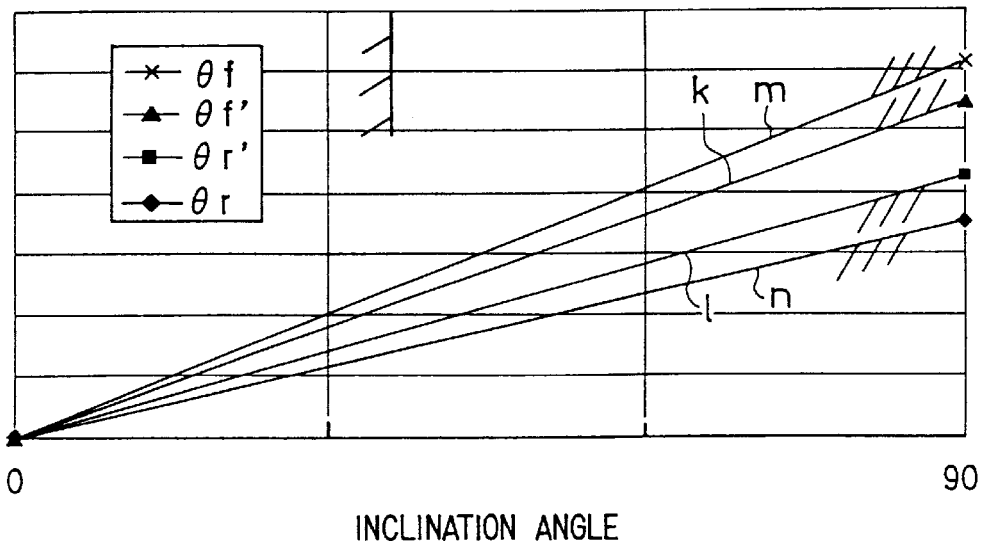
FIG. 8 is a graph showing a relation of inclination angles of the blade wall surface.

As is apparent from FIGS. 6 and 8, the inclination angle θf (indicated with a straight line m in FIG. 8) of the outer periphery portion 46*a* of each blade 45 is larger than the inclination angle θr' (indicated with a straight line l in FIG. 8) of the outer periphery portion 47*a*, and the inclination angle θf' (indicated with a straight line k in FIG. 8) of the inner periphery portion 46*c* is larger than the inclination angle θr (indicated with a straight line n in FIG. 8) of the inner periphery portion 47*c*. Thus, in this state, both outer periphery sides and both inner periphery sides of blades 45 are each given a "draft angle."

Moreover, the inclination angle θf' of the inner periphery portion 46*c* indicated with a straight line k is smaller than the inclination angle θf of the outer periphery portion 46*a* indicated with a straight line m, and the inclination angle θr' of the outer periphery portion 47*a* indicated with a straight line l is larger than the inclination angle θr of the inner periphery portion 47*c* indicated with a straight linen. Further, the inclination angle θf' of the inner periphery portion 46*c* indicated with a straight line k is larger than the inclination angle θr' of the outer periphery portion 47*a* indicated with a straight line l, and the inclination angle θf of the outer periphery portion 46*a* indicated with a straight line m is larger than the inclination angle θr' of the inner periphery portion 47*c* indicated with a straight line l. Therefore, the draft angle is maintained.

According to the above relations, when a molding die is retracted after molding of the impeller 40, it can be removed easily without interference between its projections and blades 50 insofar as the inclination angle relations lie within the area enclosed with the straight lines k and l.

<Second Embodiment>

(Construction)

An entire construction of a turbine type fuel pump according to this second embodiment is the same as that of FIG. 1 referred to above, so an explanation thereof will here be omitted.

Figure 9:
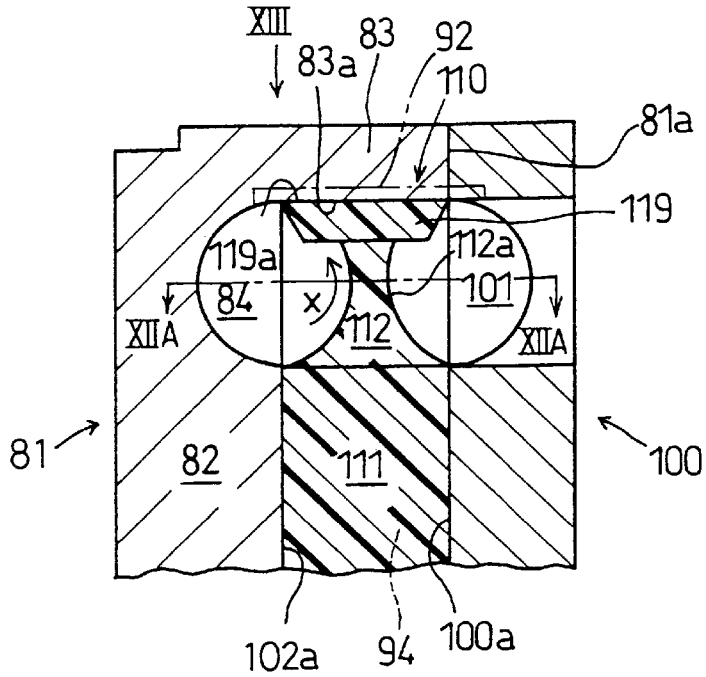
FIG. 9 is a vertical sectional view of a turbine type fuel pump according to a second embodiment of the invention.
Figure 10:
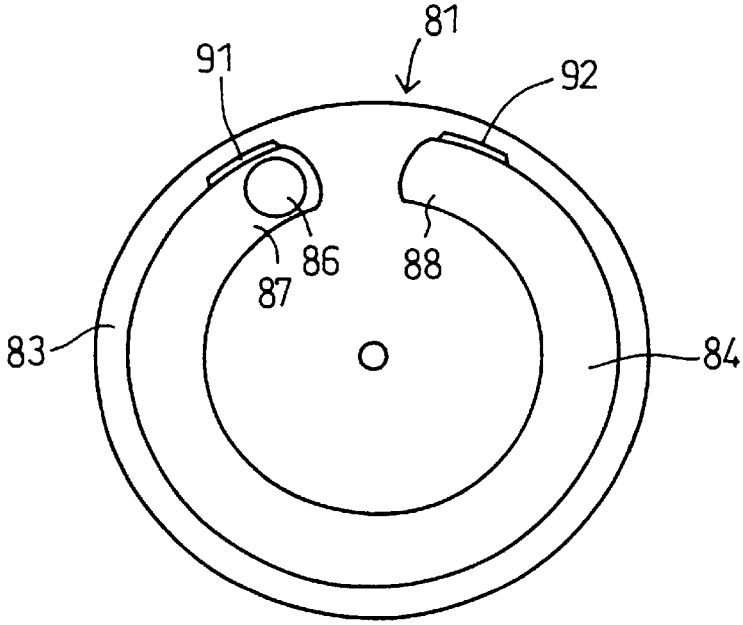
FIG. 10 is an inner side view of a casing body according to the second embodiment.
Figure 11:
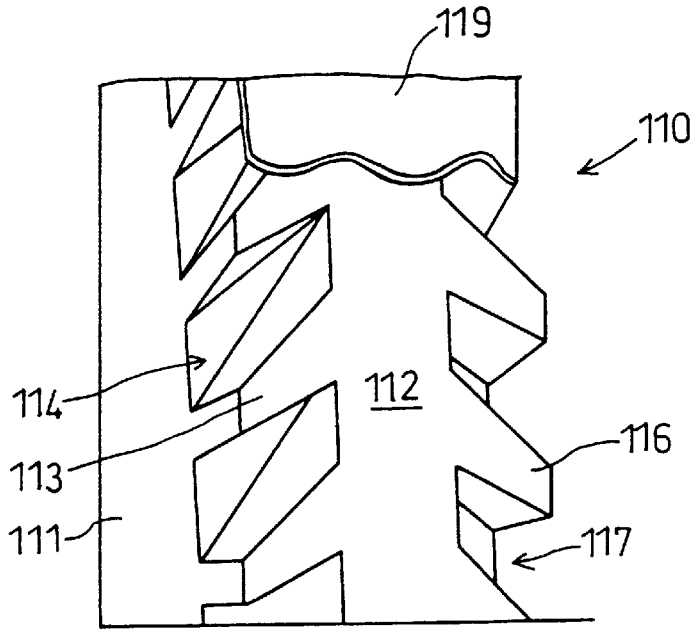
FIG. 11 is a perspective view of a principal portion of an impeller according to the second embodiment.

The pump section will now be described with reference to FIGS. 9 to 13. As shown in FIG. 9, on a side of an inner side face (right side face in FIG. 9) 81*a* of a suction-side pump cover 81 there are formed a bottom wall 82 and a circumferential wall 83 around the bottom wall, and a central portion of the bottom wall 82 forms a guide surface 102*a* of an impeller 110. As shown in FIGS. 9 and 10, a C-shaped side groove 84 having a semi-circular section is formed in an outer periphery portion on the guide surface 102*a*. The side groove 84 extends from a start end portion 87 communicating with a fuel suction port 86 which is formed at a predetermined angle relative to the axis of the pump cover 81, up to a terminal end portion 88 communicating with a terminal end portion of a side groove 101 of a pump casing 100 which will be described later.

As shown in FIG. 10, communicating passages 91 and 92 are formed respectively on outer periphery sides of the start and terminal end portions 87, 88 of the side groove 84 in the pump cover 81. The communicating passages 91 and 92 have predetermined length, width, and depth in the circumferential, axial, and radial directions, respectively, of the pump cover 81. On one surface of the communicating passage 92 in the terminal end portion 88 (a front surface in a fuel flowing direction (upward in FIG. 13) within the side groove 84) there is formed an inclined guide surface 92*a* at a predetermined obtuse angle relative to the fuel flowing direction.

A central portion of an inner side face (left side face in FIG. 9) of the pump casing 100 forms a guide surface 100*a* of the impeller 110 and a C-shaped side groove 101 having the same semi-circular section as the side groove 84 is formed along an outer periphery portion on the inner side face (guide surface 100*a*). The side groove 101 extends from a start end portion to a terminal end portion communicated with a fuel discharge port (refer to 33 in FIG. 1) which is formed in parallel with the axis of the pump casing 100.

Like communicating gaps are formed also on outer periphery sides of the start and terminal end portions of the side groove 101 of the pump casing 100 and are in communication respectively with the communicating passages 91 and 92 formed in the pump cover 81. A letter C-shaped pump channel is constituted by the side groove 101 of the pump casing 100 and the side groove 84 of the pump cover 81.

As is apparent from FIG. 9, the width of an annular partition wall 112 located outside a body 111 of the impeller 110 first gradually decreases and then gradually increases radially outwards. As is seen from FIGS. 11 and 12A, plural blades 113, 116 and blade grooves 114, 117 are formed zigzag on both left and right sides of the partition wall 112. In the circumferential direction of the impeller 110 the left-hand (one-side) blades 113 correspond to the right-hand (right-side) blade grooves 117, while the left-hand blade grooves 114 correspond to the right-hand blades 116.

Besides, in the rotational direction of the impeller 110, the angle θ1 of a rear wall surface 113*a* of each blade 113 (a front surface of each blade groove 114) relative to a left side face 118 is smaller than the angle θ2 of a front wall surface 113*b* of the blade 113 (a rear side of the blade groove 114). As a result, the thickness of the blade 113 gradually increases and the spacing between blade grooves 114 gradually decreases toward the transversely central portion 1 from the left side face 118. This is also the case with the right-hand blades 116 and blade grooves 117. The left-hand blade grooves 114 each have a transverse length (depth) reaching the transversely central portion 1 of the partition wall 112 and an inner surface 114*c* thereof lies near the central portion l. This is also the case with the right-hand blade grooves 117 (see FIG. 12B).

An outer periphery surface 119*a* of a ring portion 119 is opposed to an inner periphery surface 83*a* of the circumferential wall 83. The ring portion 119 isolates the left and right side grooves 84, 101. The body 111, partition wall 112, left and right blades 113, 116, and ring portion 119 are integrally formed of a resin material.

(Function and Advantage)

In FIGS. 1 and 10, fuel is sucked into the start end portion 87 from a fuel suction port 86. The fuel inlet port 86 is inclined relative to an inner side face 81*a* of the pump cover 81, so that the fuel flows smoothly into the side groove 84. Further, the fuel flows into the side groove 101 in the pump casing 100 through the communicating passage 91, etc.

Figure 12A:
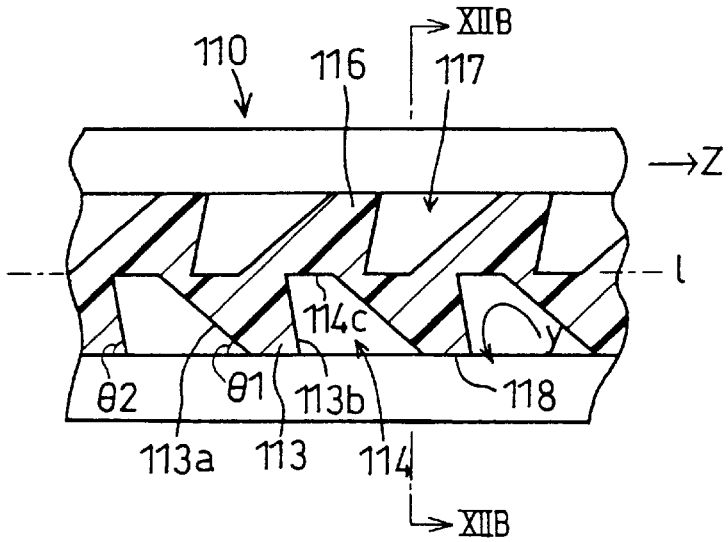
FIG. 12A is a sectional view taken on line XIIA—XIIA in FIG. 9

The fuel undergoes inward forces in both circumferential and transverse directions from the blades 113 and 116 of the impeller 110 which rotates in the direction of arrow z in FIG. 12A, and within the blade grooves 114 and 117 the fuel flows from the rear inner diameter side to the front outer diameter side of the blade grooves 114 and 117 as indicated with arrow y in FIG. 12A. The blades 113, 116 and the blade grooves 114, 117 are inclined forward in the rotational direction; besides, the angle θ1 is smaller than the angle θ2. Consequently, it becomes easier for the fuel to flow into the blade grooves 114 and 117 and internal stagnation does not occur, so that there is obtained a high efficiency.

Figure 12B:
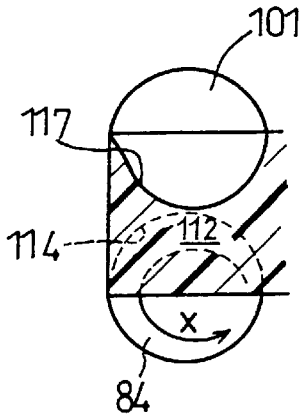
FIG. 12B is a sectional view taken on line XIIB—XIIB in FIG. 12A.
Figure 13:
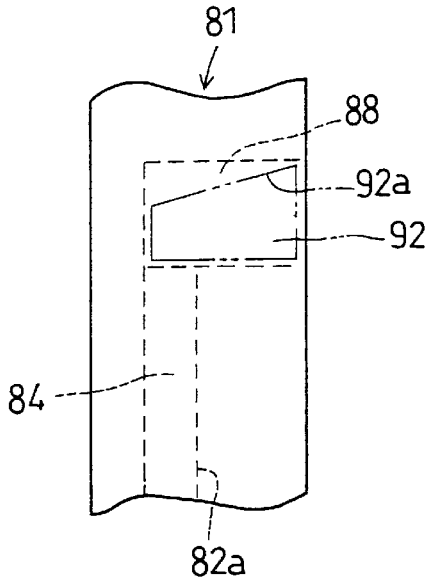
FIG. 13 is a view as seen in the direction of arrow XIII in FIG. 9.

With a centrifugal force induced by rotation, fuel flows radially outwards within the blade grooves 114 and 117 while being guided by both side faces 112*a* of the partition wall 112, as indicated with arrow x in FIGS. 9 and 12B. At this time, stagnation and collision of both right- and left-side fuel flows are prevented by both partition wall 112 and ring portion 119.

Further, fuel efflux timings on both right and left sides are shifted from each other by the ring portion 119 formed in the impeller 110 and by the zigzag arrangement of the left-hand blades 113, blade grooves 114 and right-hand blades 116, blade grooves 117. As a result, pressure pulsation at the terminal end portion 18 of the pump channel, etc. is prevented. Thereafter, the fuel is guided by the inner surface of the ring portion 119 and branches to both right and left sides, then flows into the left and right side grooves 84, 101. Within the side grooves 84 and 101 the fuel flows radially inwards and axially inwards, then flows into rear-side blade grooves 114 and 117 from their inner periphery side in the circumferential direction.

Thus, while circulating independently between the left blade grooves 114 and side groove 84 and also between the right blade grooves 117 and side groove 101, the fuel flows from the start end portion 87, etc. toward the terminal end portion 88, etc. During this period the fuel pressure is increased. The fuel which has reached the terminal end portion 88 of the side groove 84 is changed its flowing direction into the axial direction by the inclined guide surface 92*a* and joins the flow in the terminal end portion of the side groove 101 through the communicating passage 92, etc. In this case, since the left- and right-hand blade grooves 114, 117 extend to near the central portion l, the blade grooves 114 and 117 increase in volume, so that the circulatability of fuel in the interior thereof is improved and the amount of fuel discharged from the fuel discharge port (refer to 33 in FIG. 1) increases.

<Third Embodiment>

(Construction)

Figure 14:
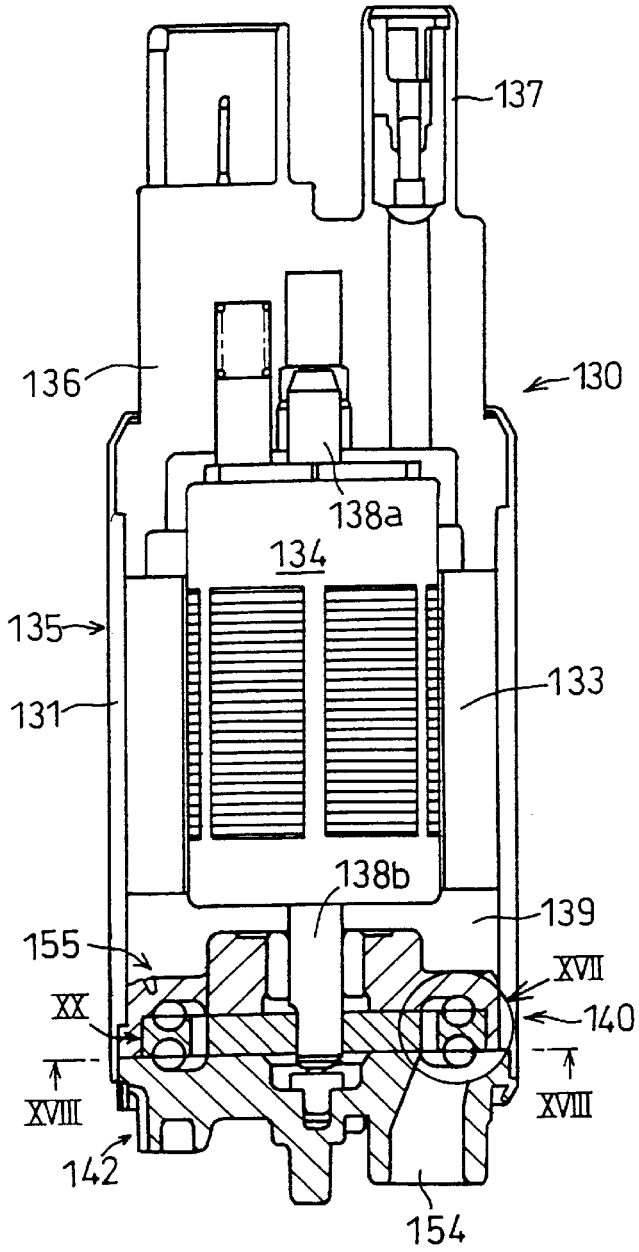
FIG. 14 is a vertical sectional view of a fuel pump according to a third embodiment of the invention.

As shown in FIG. 14 which illustrates the whole of a turbine type fuel pump, the fuel pump is made up of a cylindrical pump housing 130, as well as a motor section 135 and a pump section 140 both received within the pump housing 130.

The pump housing 130 includes a casing 131 and a holder 136. In the holder 136 is formed a fuel supply section 137 for the supply of fuel to a fuel injection system. An annular permanent magnet 133 is mounted to an inner periphery surface of the casing 131 and an armature 134 is disposed inside the permanent magnet 133. A shaft 138*a* projects upward from the armature 134 and is supported rotatably by the holder 136, while a shaft 138*b* projects downward and is supported rotatably by a pump housing 141 which will be described below. The permanent magnet 133 and the armature 134 constitute the motor section 135.

The pump section 140 will now be described with reference to FIGS. 15 to 18. The pump section 140 is roughly divided into a pump housing 141 and an impeller 160. The pump housing 141 is made up of a pump casing 155 located on a discharge side (upper side) and a casing cover 142 integral with the pump casing 155 and located on a suction side (lower side). A chamber 159 is formed between the motor section 135 and the pump section 140.

Figure 15:
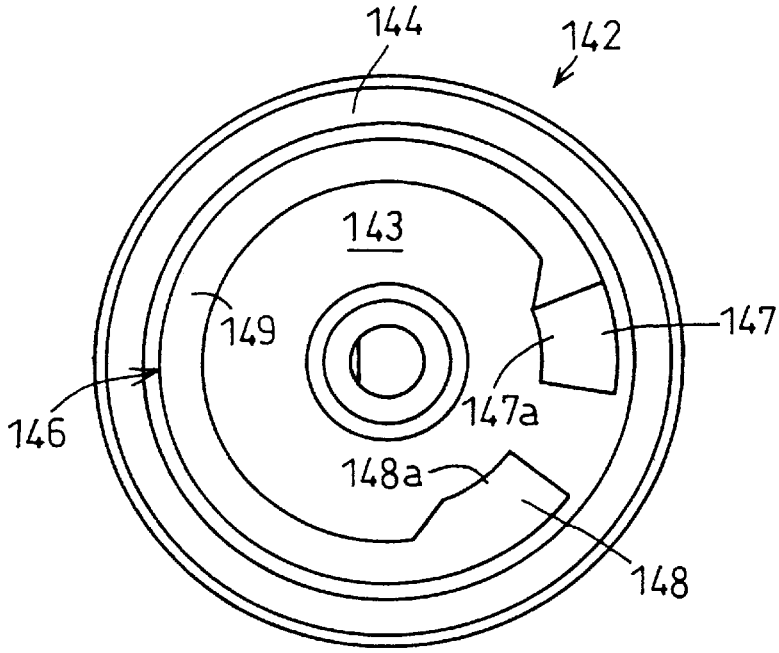
FIG. 15 is a plan view of a casing body according to the third embodiment.
Figure 17:
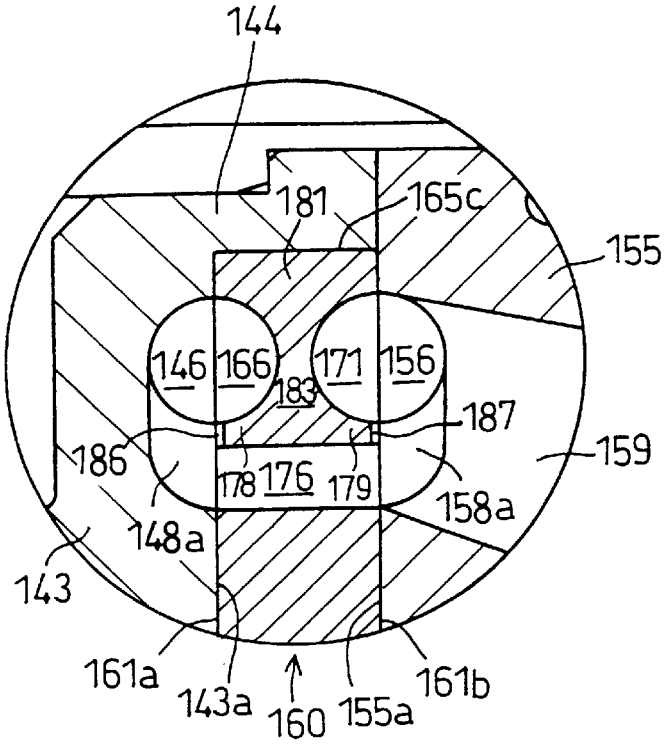
FIG. 17 is an enlarged view of portion XVII in FIG. 14, showing an impeller and the vicinity thereof according to the third embodiment.

As shown in FIGS. 15 and 17, the suction-side pump cover 142 has a container shape and is made up of a circular bottom wall 143 and a peripheral wall 144 formed around the bottom wall. One side groove 146 having a bottom of a predetermined shape is formed in an outer periphery portion of an inner surface (bottom surface) 143*a* of the bottom wall 143. As shown in FIG. 15, the side groove 146 has a start end portion 147, a terminal end portion 148, and a C-shaped groove 149 extending from the start end portion 147 to the terminal end portion 148. In the start end portion 147 the side groove 146 is communicated with a fuel suction port (not shown). The start end portion 147 and the terminal end portion 148 are respectively provided with first and second communicating depressions 147*a*, 148*a* radially inwards.

Figure 16:
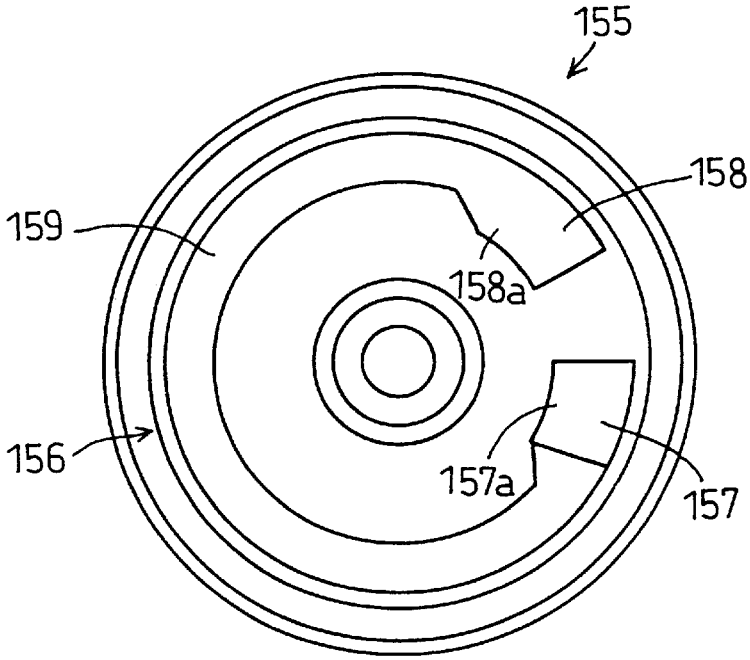
FIG. 16 is a plan view of a casing cover according to the third embodiment.

As shown in FIGS. 16 and 17, the discharge-side pump casing 155 is in the shape of a flat plate, and an opposite-side side groove 156 having a bottom of a predetermined shape is formed in an outer periphery portion of an inner surface 155*a* of the pump casing 155, which side groove 156 is opposed to the side groove 146. As shown in FIG. 16, the side groove 156 has a start end portion 157, a terminal end portion 158, and a C-shaped groove 159 extending from the start end portion 157 to the terminal end portion 158. In the start end portion 157 the side groove 156 is communicated with a fuel discharge port. The start end portion 157 and the terminal end portion 158 are respectively provided with third and fourth communicating depressions 157*a*, 158*a* radially inwards.

The inner surface 143*a* of the pump cover 142 and the inner surface 155*a* of the pump casing 155 form an impeller receiving space of a circular shape having a predetermined certain width. The side groove 146 of the pump cover 142 and the side groove 156 of the pump casing 155 form a C-shaped pump channel extending from the start end portions 147 and 157 up to the terminal end portions 148 and 158.

Figure 18:
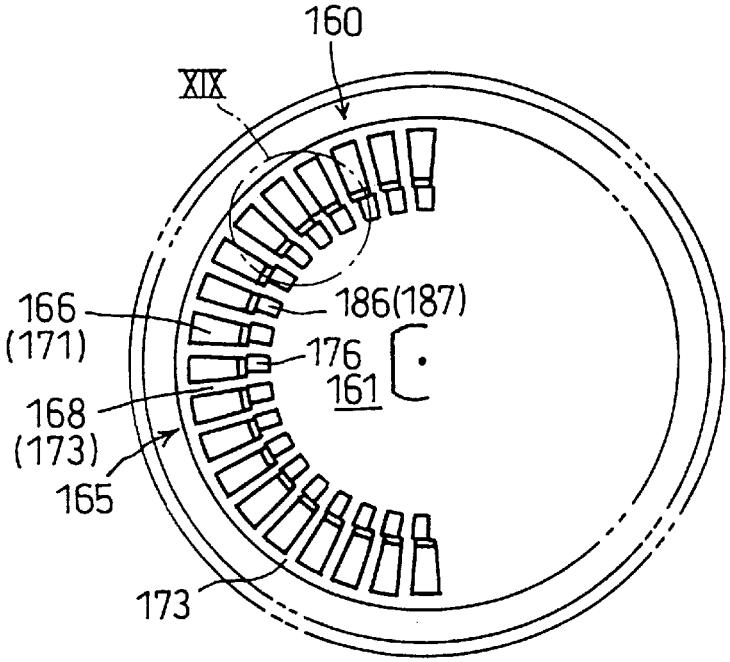
FIG. 18 is a sectional view taken on line XVIII—XVIII in FIG. 14.
Figure 19:
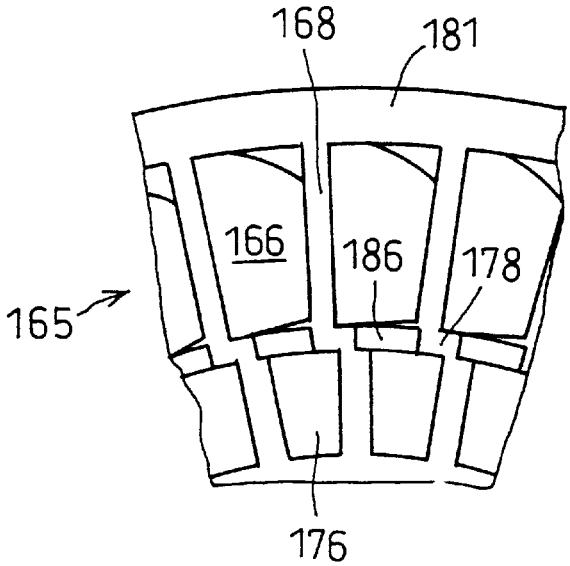
FIG. 19 is an enlarged view of portion XIX in FIG. 18.

As is apparent from FIGS. 17, 18 and 19, the impeller 160, which is formed of a synthetic resin, comprises circular body portion 161 and an annular outer periphery portion 165 located on an outer periphery side of the body portion 161. The body portion 161 has one side face 161*a* which is guided by the inner surface 143*a* of the casing body 143 and an opposite side face 161*b* which is guided by the inner surface 155*a* of the casing cover 155. On one side face 161*a* and an opposite side face 161*b* of the outer periphery portion 165 and at a position slightly deviated radially inwards from an outer periphery surface 165*c* there are formed a large number of blade grooves 166 and 171 spacedly at equal pitches in the circumferential direction.

As is apparent from FIG. 19, one blade grooves 166 each have an opening portion. A side face shape of the opening portion is a generally rectangular shape which is long in the radial direction (more exactly, the width on the outer periphery side (circumferential size) is a little larger than that on the inner periphery side). As is seen from FIG. 17, a sectional shape in the depth direction of each blade groove 166 is generally semi-circular and a radial length of each blade groove is almost equal to that of the side groove 146. The depth of each blade groove 166 is smaller than half of the plate thickness of the impeller 160.

Figure 20:
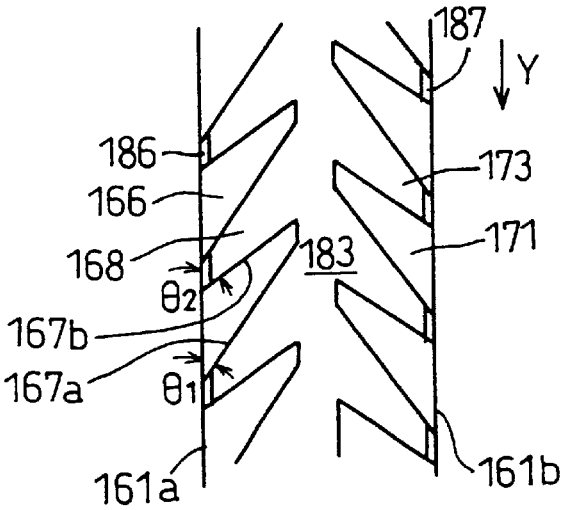
FIG. 20 is a view as seen in the direction of arrow XX in FIG. 14.

As is apparent from FIG. 20, the blade grooves 166 and 171 are circumferentially displaced from each other by a distance corresponding to half of their forming pitch. Consequently, as is seen from FIG. 20, the blade grooves 166 and 171 are arranged zigzag and the blades 168 and 173 are also arranged zigzag.

Each blade groove 166 is inclined so that its inner side with respect to a rotational direction Y of the impeller 160 is located at a more rear position than the inlet (opening) side, with its width becoming narrower toward the inner side. To be more specific, the angle θ1 of a rear wall surface 167*a* of each blade 168 (a front wall surface of each blade groove 166) relative to one side face 165*a* of the outer periphery portion 165 is smaller than the angle θ2 of a front wall surface of the blade 168 (a rear wall surface of the blade 166) relative to one side face 165*a*. This condition is also true of the opposite-side blade grooves 171.

As shown in FIGS. 17 and 19, the blade grooves 166 on one side face 161*a* and the blade grooves 171 on the opposite side face 161*b*, which are arranged zigzag, are isolated from each other and do not open to the outer periphery surface 165*c* of the impeller 160. As a result, as is apparent from FIGS. 18 and 19, on one side 161*a* of the outer periphery portion 165, the same number of blades 168 as the number of blade grooves 166 are formed between adjacent blade grooves 166. The thickness and height of each blade 168 are the same as the width and height of each blade groove 166. Likewise, on the opposite side face 161*b*, the same number of blades 173 as the number of blade grooves 171 are formed between adjacent blade grooves 171.

In the outer periphery portion 165, an outer annular portion 181 extending axially and circumferentially is formed on the outer periphery side of the blade grooves 166 and 171. Further, a partition wall 183 extending radially and circumferentially is formed between one-side blade grooves 166 and the opposite-side blade grooves 171.

As is apparent from FIGS. 18 and 19, in positions spaced a little radially inwards from the blade grooves 166 and 171 and displaced in the circumferential direction (clockwise) there are formed communicating holes 176 which extend axially through the outer periphery portion 165 from one side face 161*a* toward the opposite side face 161*b*. The communicating holes 176 are open in one and opposite side faces 161*a*, 161*b*. The amount of displacement of each communicating hole from each blade groove is half of the blade groove forming pitch.

The number of the communicating holes 176 is equal to that of the blade grooves 166 and 171. A side face of each communicating hole 176 is in a rectangular shape wherein a vertical (radial) size is a little larger than a transverse size. The width on the outer periphery side of each communicating hole 176 is a little smaller than the width on the inner periphery side of each of the inner blade grooves 166 and 171, and the width on the inner periphery side of each communicating hole 176 is a little smaller than the width on the outer periphery side thereof. The distance between adjacent communicating hole 176 is almost equal to a circumferential length of each of the communicating depressions 147*a* and 148*a* formed in the start end portion 147 and terminal end portion 148 of the side groove 146.

The height of each communicating hole 176 is about half of the height of each of blade grooves 166 and 171 and is almost equal to a radial size of each of the communicating depressions 147*a* and 148*a* formed in the start and terminal end portions 147, 148 of the side groove 146 in the pump cover 142. The communicating holes 176 are uniform in width and height throughout the overall length.

Projections 178 and 179 are formed radially inwards of each blade groove 166 and each blade groove 171, respectively. On one side face 165*a*, shallow grooves 186 are formed in the projections 178, and on the opposite side face 165*b*, shallow grooves 187 are formed in the projections 179. Here attention is paid to each blade groove 166 and each blade groove 171 which, when viewed from one side face 161*a* side, is displaced clockwise by ½ pitch from the blade groove 166. The shallow groove 186 has a width a little smaller than the width of the blade groove 166 and is formed radially inwards of the blade groove 166 in a clockwise displaced state by ¼ pitch. Further, the shallow groove 187 has a width a little smaller than the width of the blade groove 171 and is formed radially inwards of the blade groove 171 in a counterclockwise displaced state by ¼ pitch.

As a result, when viewed from one side face 161*a* (in plan view), the shallow grooves 186 and 187 overlap each other in the respective corresponding portions in the circumferential direction. Each communicating hole 176 is formed radially inside of the overlapped portion. Thus, the blade grooves 166 and 171 are communicated with each other by the shallow groove 186, communicating hole 176 and shallow groove 187.

The blade grooves 166 and 171 arranged in a zigzag fashion are communicated with each other by the shallow grooves 186, 187 and the communicating holes 176. The width of each shallow groove 186 is almost equal to the width on the inner periphery side of each blade groove 166, i.e., the width on the outer periphery side of each communicating hole 176, and the depth thereof is about one per several, i.e., several fractions, of the depth of each blade groove 166. As a result, the shallow groove 166 is depressed from one side face 165*a* by an amount corresponding its depth. This condition is also true of the projections 179 on the opposite side face 165*b* and the shallow grooves 187 formed thereon.

The impeller 160 has been formed by molding with a pair of molds (not shown) which have recesses of a predetermined shape in their surfaces opposed to each other and which are movable toward and away from each other. One mold is provided on an inner wall surface of cavity with convex portions for forming blade grooves 166, left halves of communicating holes 176, and shallow grooves 186, and the other mold has convex portions for forming blade grooves 171, right halves of communicating holes 176, and shallow grooves 187.

As is apparent from FIG. 17, the impeller 160 constructed as above is received rotatably within the impeller receiving space of the casing 141 and the one side face 161*a* thereof is guided by the inner surface 143*a* of the pump cover 142, while the opposite side face 161*b* thereof is guided by the inner surface 155*a* of the pump casing 155. In this state, a large number of blade grooves 166 and blades 168 are opposed to the side groove 146 in the axial direction and a large number of blade grooves 171 and blades 173 are opposed to the side groove 156. Further, openings of the communicating holes 176 on one side face 161*a* side are opposed to the communicating depressions 147*a* and 148*a* in the start end portion 147 and terminal end portion 148 of the casing body 142 and openings thereof on the opposite side face 161*b* side are opposed to the communicating depressions 157*a* and 158*a* in the start end portion 157 and terminal end portion 158 of the casing cover 155.

Between one side face 161*a* of the impeller 160 and the inner surface 143*a* of the pump cover 142 and also between the opposite side face 161*b* and the inner surface 155*a* of the pump casing 155 there are formed gaps (see FIG. 17) by the spaces of shallow grooves 186 and 187. The gaps provide communication of the blade grooves 166 and 171 with the communicating holes 176.

(Operation)

In the fuel pump of the third embodiment, the fuel fed from the fuel suction port 154 in the pump cover 142 flows from the start end portion 147 of the side groove 146 into the blade grooves 166 in the impeller 160. At the same time, the fuel present within the start end portion 147 flows from one side face 161*a* to the opposite side face 161*b* in the impeller 160 through communicating holes 176 and enters the start end portion 157 of the side groove 156 and blade grooves 171 in the impeller 160.

The fuel which has entered portions close to the inner peripheries of the blade grooves 166 and 171 undergoes a circumferential force from the blades 168 and 173 of the impeller 160 which is rotating, and with the resulting centrifugal force, the fuel flows radially outwards within the blade grooves 166 and 171 in FIG. 17. Thereafter, the fuel is guided to portions close to outer peripheries of the blade grooves 166 and 171, branches axially outwards (right and left directions), flows into the side grooves 146 and 156 and is guided radially inwards and axially inwards, then returns to the blade grooves 166 and 171.

At the same time, in FIG. 19, the fuel flows into the blade grooves 166 and 171 from the front wall surfaces 167*b* side of the blades 168 and 173 and then flows out from the rear wall surfaces 167*a* side.

The fuel which has thus entered the pump cover 142 side repeats circulation between the blade grooves 166 and the side groove 146 and flows spirally from the start end portion 147 toward the terminal end portion 148 within the pump channel. The fuel which has entered the pump casing 155 side repeats circulation between the blade grooves 171 and the side groove 156 and flows spirally from the start end portion 157 toward the terminal end portion 158 within the pump channel. In this way the fuel is fed successively to the terminal end portions 148 and 158 and the pressure thereof increases.

The fuel having been increased its pressure by the blade grooves 166 and side groove 146 and reached the terminal end portion 148 is changed its flowing direction approximately 90° by the wall surface of the terminal end portion 148 and thereafter flows through the communicating holes 176 in the impeller 160 from one side face 161*a* to the opposite side face 161*b*. The fuel having been increased its pressure by the blade grooves 171 and side groove 156 and reached the terminal end portion 158 is changed its flowing direction approximately 90° by the wall surface of the terminal end portion 148. In this way the fuel is pressurized independently on the suction side and the discharge side, then the thus-pressurized fuel portions join together and the joined fuel flow is fed from the fuel discharge port (not shown) to the fuel supply section 137 through the chamber 139.

(Advantage)

According to the third embodiment, a communicating means for communication between one side face 161*a* and the opposite side face 161*b* of the impeller 160 is present neither within the blade grooves 166 nor within the blade grooves 171. Moreover, the outer annular portion 181 is present on the outermost periphery of the impeller 160 and neither the blade grooves 166 nor the blade grooves 171 are open in the outer periphery surface 165*c*. Further, a communicating means for communication between the blade grooves 166 and 171 at the outermost periphery of the impeller 160 is formed neither in the pump cover 142 nor in the pump casing 155. As a result, increasing the fuel pressure in one-side blade grooves 166 and side groove 146 and increasing the fuel pressure in the opposite-side blade grooves 171 and side groove 156 are performed each independently.

Therefore, the shape, size and number of the blade grooves 166 and 171 can be determined with importance attached to increasing the fuel pressure. Therefore, the blade grooves 166 and 171 are, as a whole, inclined forward with respect to the rotational direction of the impeller 160 and are designed so as to become narrower in width from the opening side toward the inner side of those blade grooves. As a result, fuel circulates spirally between one-side blade grooves 166 and the side groove 146 and also between the opposite-side blade grooves 171 and the side groove 156, during which period the fuel pressure rises efficiently.

Secondly, since the communicating holes 176 are formed in portions deviated radially inwards from the blade grooves 166 and 171, the shape, size and number of the communicating holes 176 can be determined with emphasis laid on an optimum flow of fuel from the communicating depression 147*a* in the suction-side start end portion 147 to the communicating depression 157*a* in the discharge-side start end portion 157 and an optimum flow of fuel from the communicating depression 148*a* in the suction-side terminal end portion 148 to the communicating depression 158*a* in the discharge-side terminal end portion 148.

In this connection, the communicating holes 176 for communication of the blade grooves 166 and side groove 146 with the blade grooves 171 and side groove 156 are formed in the impeller 160 itself. Therefore, the impeller 160 is prevented from moving in any radial direction under the pressure of fuel acting on the inner wall surfaces of the communicating holes 176.

Thirdly, in the projections 178 and 179 are formed shallow grooves 186 and 187 in the same number as the blade grooves 166 or 171 for communication between the blade grooves 166 or 171 and the communicating holes 176. With such shallow grooves, even when one openings of communicating holes 176 do not confront the start and terminal end portions 147, 148 of the side groove 146 and the other openings of communicating holes 176 do not confront the start and terminal end portions 157, 158 of the side groove 156, the blade grooves 166 and the side groove 146 are put in communication with the blade grooves 171 and the side groove 156 through shallow grooves 186 and communicating holes 176 and 187. Therefore, when the fuel pressure in the blade grooves 166 and side groove 146 and the fuel pressure in the blade grooves 171 and side groove 156 lose balance, the fuel flows from the higher to the lower pressure side to balance both pressures, whereby a slight displacement in the axial direction of the impeller is prevented.

Fourthly, breakage of the projections 178 and 179 is difficult to occur during molding of the impeller 160 using a pair of molds. This is because the communicating holes 176 are formed a little away from the blade grooves 166 and 171 radially inwards and the projections 178 and 179 which remain between the two have a certain thickness (radial length).

(Modifications of Impeller)

Figure 21:
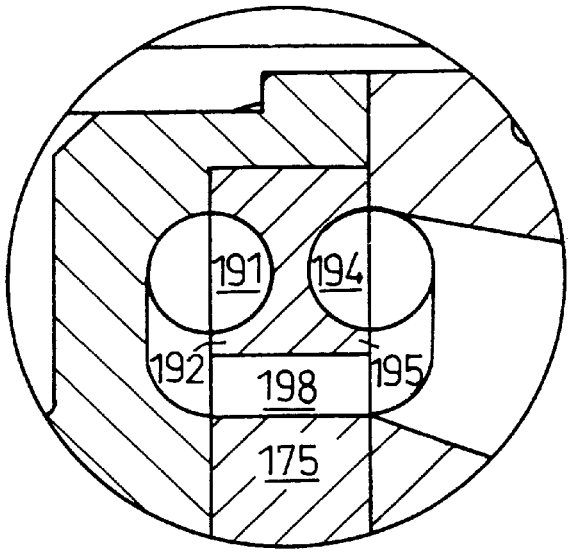
FIG. 21 is a sectional view of a principal portion, showing a first modification of impeller according to the third embodiment.

A first modification of the impeller 160 of the third embodiment is shown in FIG. 21. This modified impeller is different from the impeller of the third embodiment in that the shallow grooves 186 and 187 are not formed. Although projections 192 and 195 are present between blade grooves 191, 194 and communicating holes 198, shallow grooves are not formed in their projecting ends.

In the first modification there is not obtained the third advantage in the first embodiment, but the foregoing first, second and fourth advantages can be obtained and thus the first modification is superior in various points to the conventional examples.

Figure 22:
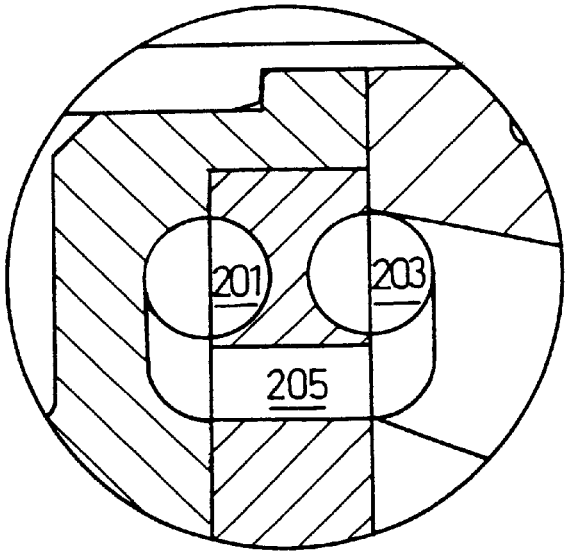
FIG. 22 is a sectional view of a principal portion, showing a second modification of impeller according to the third embodiment.

A second modification of impeller is shown in FIG. 22. This impeller is different from the first embodiment in that the projections 178, 179 and the shallow grooves 186, 187 are not formed. Communicating holes 205 are formed radially inside of blade grooves 201 and 203, leaving no space, and there are found no portions corresponding to the projections 178 and 179.

In the second modification there are not obtained the third and fourth advantages in the first embodiment. However, the foregoing first and second advantages can be obtained and thus the second embodiment is superior in various points to the conventional examples.

<Fourth Embodiment>

(Construction)

Figure 23:
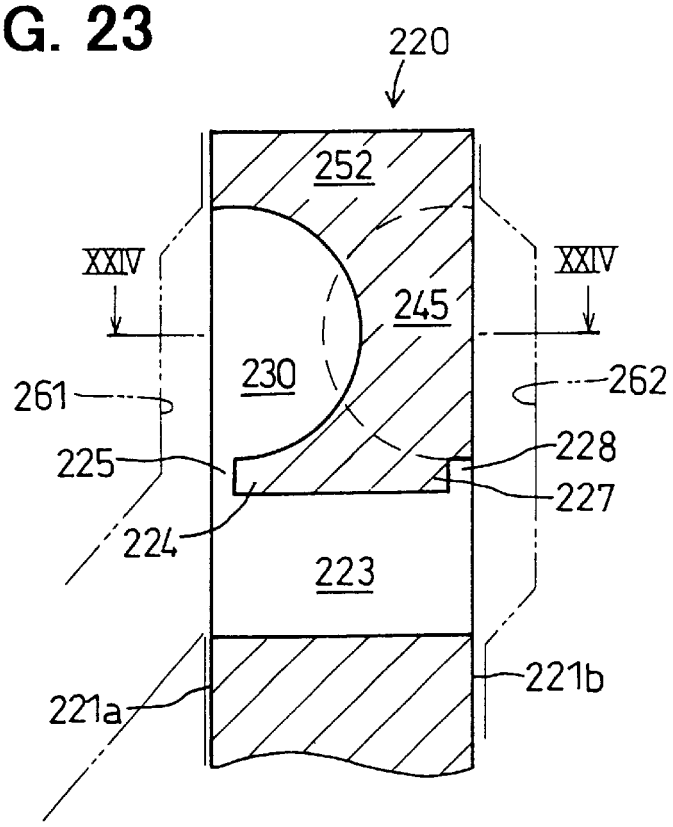
FIG. 23 is a vertical sectional view showing an impeller according to a fourth embodiment of the invention.
Figure 24:
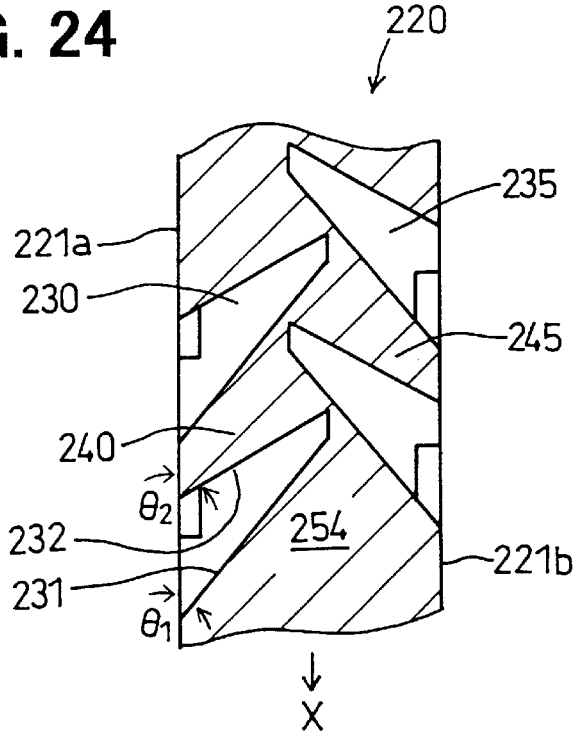
FIG. 24 is a sectional view taken on line XXIV—XXIV in FIG. 23.
Figure 25:
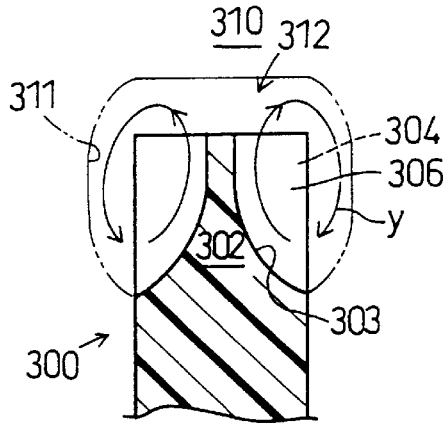
FIG. 25 PRIOR ART
FIG. 25 is a vertical sectional view of a principal portion of a first conventional example as prior art.
Figure 26:
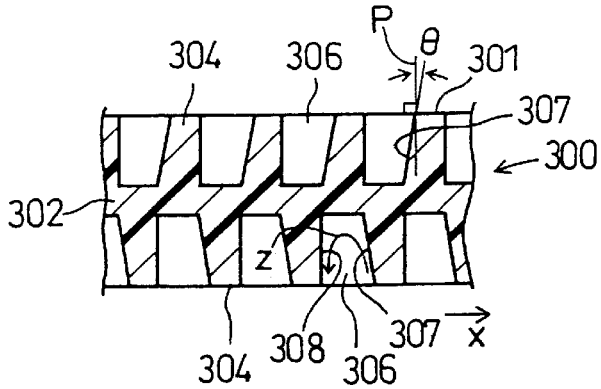
FIG. 26 PRIOR ART
FIG. 26 is a lateral sectional view of the principal portion of the first conventional example.
Figure 27:
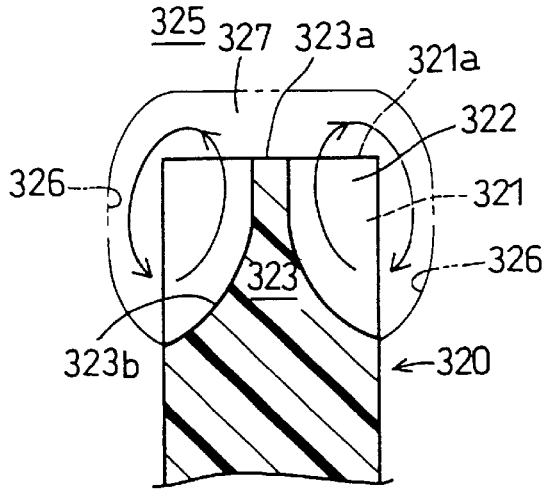
FIG. 27 PRIOR ART
FIG. 27 is a sectional view of a principal portion, showing a second conventional example as prior art.
Figure 28:
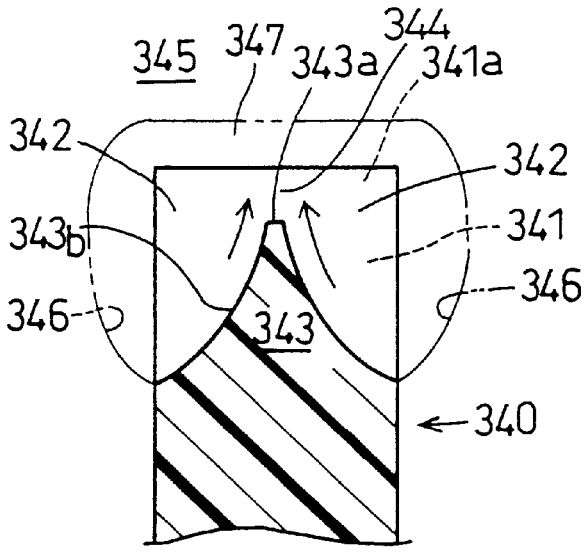
FIG. 28 PRIOR ART
FIG. 28 is a sectional view of a principal portion, showing a third conventional example as prior art.
Figure 29:
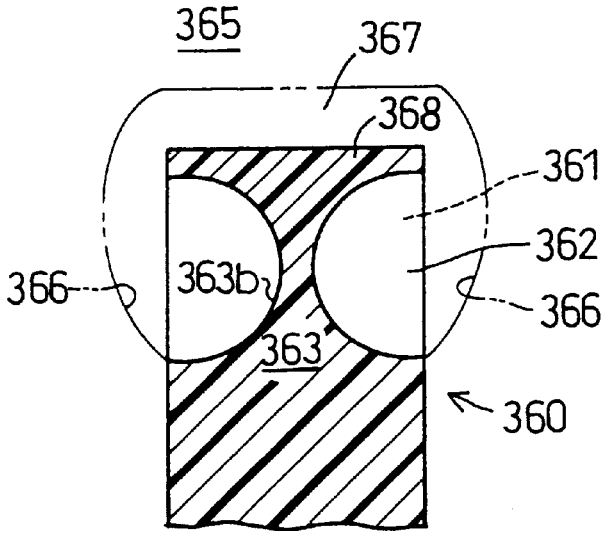
FIG. 29 PRIOR ART
FIG. 29 is a sectional view of a principal portion, showing a fourth conventional example as prior art.
Figure 30:
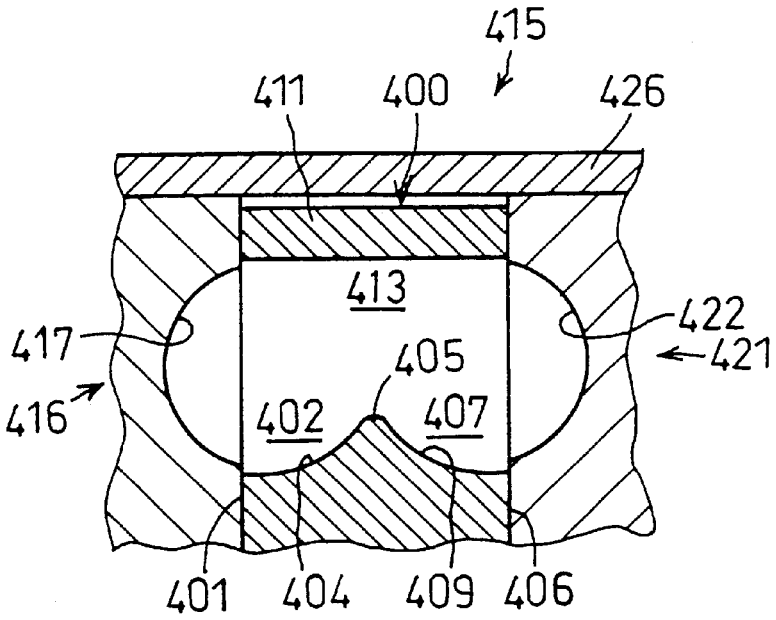
FIG. 30 PRIOR ART
FIG. 30 is a vertical sectional view of a principal portion, showing a fifth conventional example as prior art.
Figure 31:
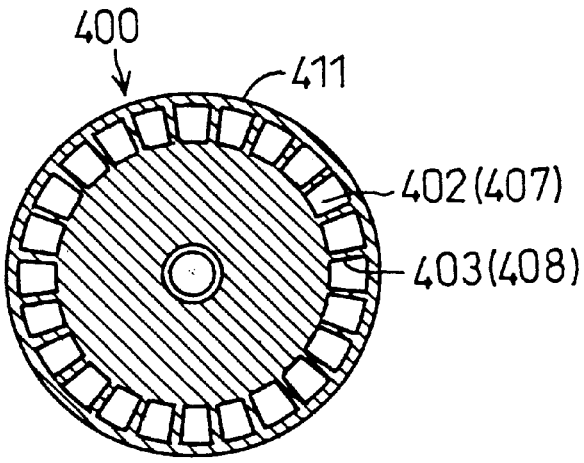
FIG. 31 PRIOR ART
FIG. 31 is a side view of an impeller in FIG. 30.

A principal portion (impeller) of a fourth embodiment of the present invention is illustrated in FIGS. 23 and 24. The fourth embodiment is common to the above third embodiment in that communicating holes 223 are formed radially inside of blade grooves 230 and 235 in an impeller 220 and in that no communicating portion is formed in a pump housing (not shown). However, the construction (especially axial length) of one- and opposite-side blade grooves 230, 235 is different from that in the third embodiment.

More specifically, an outer periphery portion of the impeller 220 includes an outer annular portion 252, a partition wall 254 and plural blades 240, 245, with plural blade grooves 230 and 235 being defined by the plural blades 240 and 245.

A side face shape of an opening of each one-side blade groove 230 is a generally rectangular shape which is long in the radial direction, a sectional shape thereof in the depth direction is generally semi-circular, and a radial length thereof is almost equal to the radial length of side grooves 261 and 262. Here, attention should be paid to an axial length, i.e., depth, of each blade groove 230 located on one side face 221*a*. The depth extends to an opposite side face 221*b* beyond an axially central part of the impeller 220 and is larger than half of the plate thickness.

Each blade groove 230 is inclined so that an inner side with respect to a rotational direction X of the impeller 220 is located at the rear of an inlet (opening) side. The width of the blade groove 230 becomes narrower toward the inner side. To be more specific, the angle θ1 of a front wall surface 231 of the blade groove 230 relative to one side face 221*a* is smaller than the angle θ2 of a rear wall surface 232. The opposite-side blade groove 235 has the same construction as the one-side blade groove 230.

As is apparent from FIG. 24, the blade grooves 230 and 235 are formed zigzag so as to be displaced circumferentially by a distance corresponding to half of their forming pitch. Likewise, the blades 240 and 245 are arranged zigzag. Consequently, as is seen from FIG. 23, when the impeller 220 is cut along a plane which includes the axis of the impeller, a tip end portion (the innermost portion) of each one-side blade groove 230 and that of each opposite-side blade groove 235 overlap each other. The amount of the overlap is one per several, i.e., several fractions, of the thickness of the impeller 230.

A communicating hole 223 is formed radially inside of each of the blade grooves 230 and 235, and shallow grooves 227 and 228 are formed in a pair of projections 225 and 226 respectively. Other points are the same as in the impeller 160 and fuel pump described in the third embodiment.

(Function and Advantage)

Basic functions and advantages of the fourth embodiment are common to the third embodiment. Therefore, characteristics of the blade grooves 230 and 235 can be determined independently of characteristics of the communicating holes 223; besides, movement of the impeller 220 caused by imbalance of pressure is prevented.

In addition, there are obtained the following unique advantages. Fuel flows from inside to outside in the radial direction of the blade grooves 230 and 235 (see FIG. 23). In the circumferential direction of the blade grooves 230 and 235 fuel flows in from the front wall surface 231 side and flows out from the rear wall surface 232 side (see FIG. 24). At this time, since the blade grooves 230 and 235 are axially deep, the momentum of fuel can be increased between the blade grooves 230, 235 and the side grooves 261, 262 in comparison with the impeller wherein tip end portions lie on this side of an axially central part or lie in the central part. As a result, the pump efficiency of the fuel pump increases.

[Advantage of the Invention]

According to the impeller of the present invention, as set forth above, an annular portion is formed along the outer periphery of the partition wall, allowing one- and opposite-side blade grooves to be independent of each other, and various improvements are made for the impeller and/or fuel pump. As a result, there can be obtained a fuel pump having an excellent pump efficiency.

A description will now be given with respect to each individual case. In the turbine type fuel pump of the first embodiment, the front and rear wall surfaces of each blade are inclined so that an inclination angle of the outer periphery portion of the front wall surface is larger than that of the inner periphery portion of the rear wall surface. Further, an annular portion is formed along the outermost periphery of the impeller. As a result, the present within the pump channel flows smoothly into the blade groove from the inner periphery side and flows out to the pump channel vigorously without fuel stagnation within the blade groove, whereby the pump efficiency is improved.

In the turbine type fuel pump of the second embodiment, stagnation and collision of fuel in the pump channel are prevented by the annular portion formed in the impeller and the communicating grooves formed in the pump housing. As a result, the pump efficiency increases. Besides, pressure pulsation at the terminal end portion of the pump channel is prevented by the annular portion formed in the impeller and also by the zigzag arrangement of one- and opposite-side blade grooves. As a result, the increase of fuel pressure becomes smooth.

In the impeller of the third embodiment, communicating holes extending from one side face to the opposite side face are formed in portions radially deviated from the blade grooves. As a result, characteristics of one- and opposite-side blade grooves can be determined from the standpoint of obtaining an optimal pump efficiency. In the fuel pump including this impeller, the start and terminal end portions one- and opposite-side side grooves in the pump housing have communicating passages which confront openings of communicating holes in the impeller. Therefore, at the start and terminal end portions on the suction side, fuel flows to the discharge side through the communicating holes in the impeller. As a result, not only a high pump efficiency is attained, but also the application of a radial force to the impeller under the pressure of fuel is prevented.

Further, according to the impeller and fuel pump of the fourth embodiment, there is attained a high pump efficiency and the application of a radial force to the impeller under the pressure of fuel is prevented.

What is claimed is:

1. A turbine type fuel pump comprising:

a disc shape impeller having one and opposite side faces, the impeller being provided with blades, blade grooves, and an annular portion formed on an outer periphery side of the blade grooves, the blades and the blade grooves being formed alternately in a circumferential direction on the one and opposite side faces at an outer periphery portion of the impeller, the blade grooves extending from the one side face being isolated from the blade grooves extending from the opposite side face; and a pump housing which rotatably houses the impeller therein, the pump housing having generally C-shaped side grooves on one and the opposite side in communication with the blade grooves on one and the opposite side respectively, the side grooves on one and the opposite side having start end and terminal end portions on one and the opposite side respectively, a fuel suction port communicating with the start end portion on one side, and a fuel discharge port communicating with the terminal end portion on the opposite side, wherein, both front and rear wall surfaces of each of the blades are inclined backward with respect to a rotational direction thereof in an axial direction of the impeller from each of the one and opposite side faces to make acute angles thereto, and, further, wherein, by rotation of the impeller, fuel is circulated independently between the side grooves on one and the opposite side and the blade grooves on one and the opposite side to increase the fuel pressure.

2. A turbine type fuel pump according to claim 1, wherein the pump housing is provided with a start end-side communicating portion for communication between the start end portion on one side and the start end portion on the opposite side, and a terminal end-side communicating portion for communication between the terminal end portion on one side and the terminal end portion on the opposite side.

3. A turbine type fuel pump according to claim 2, wherein the start end-side and terminal end-side communicating portions are formed to extend axially on outer periphery sides of the start and terminal end portions on one and the opposite side, respectively.

4. A turbine type fuel pump according to claim 3, wherein the communicating portion in the terminal end portion of the side groove on one side has an inclined guide surface inclined in a direction to guide fuel present within the side groove on one side to the terminal end portion of the side groove on the opposite side.

5. A turbine type fuel pump comprising:

a disc shape impeller having one and opposite side faces, the impeller being provided with blades, blade grooves, and an annular portion formed on an outer periphery side of the blade grooves, the blades and the blade grooves being formed alternately in a circumferential direction on the one and opposite side faces at an outer periphery portion of the impeller; and a pump housing which houses the impeller therein rotatably, the pump housing having generally C-shaped side grooves on one and the opposite side in communication with the blade grooves on one and the opposite side respectively, the side grooves on one and the opposite side having start end and terminal end portions on one and the opposite side respectively, a fuel suction port communicating with the start end portion on one side, and a fuel discharge port communicating with the terminal end portion on the opposite side, wherein, both front and rear wall surfaces of each of the blades are inclined backward with respect to a rotational direction thereof to make an acute angle to the respective one and the opposite side faces, wherein, by rotation of the impeller, fuel is circulated independently between the side grooves on one and the opposite side and the blade grooves on one and the opposite side to increase the fuel pressure, and wherein the angle of inclination of each of the front wall surfaces of the blades at an outer peripheral portion is larger than that of the rear wall surfaces thereof at an inner peripheral portion.

6. A turbine type fuel pump according to claim 5, wherein the angle of inclination of each of the rear wall surfaces of the blades at an outer peripheral portion is larger than that of the rear wall surfaces thereof at an inner peripheral portion.

7. A turbine type fuel pump according to claim 5, wherein the angle of inclination of each of the front wall surfaces of the blades at the outer peripheral portion is larger than that of the front wall surfaces thereof at the inner peripheral portion.

8. A turbine type fuel pump according to claim 5, wherein the angle of inclination of each of the front wall surfaces of the blades at the inner peripheral portion is larger than that of the rear wall surfaces thereof at the outer periphery portion.

9. A turbine type fuel pump comprising:

a disc shape impeller having one and opposite side faces, the impeller being provided with blades, blade grooves, and an annular portion formed on an outer periphery side of the blade grooves, the blades and the blade grooves being formed alternately in a circumferential direction on the one and opposite side faces at an outer periphery portion of the impeller; and a pump housing which houses the impeller therein rotatably, the pump housing having generally C-shaped side grooves on one and the opposite side in communication with the blade grooves on one and the opposite side respectively, the side grooves on one and the opposite side having start end and terminal end portions on one and the opposite side respectively, a fuel suction port communicating with the start end portion on one side, and a fuel discharge port communicating with the terminal end portion on the opposite side, wherein, both front and rear wall surfaces of each of the blades are inclined backward with respect to a rotational direction thereof to make an acute angle to the respective one and the opposite side faces, wherein, by rotation of the impeller, fuel is circulated independently between the side grooves on one and the opposite side and the blade grooves on one and the opposite side to increase the fuel pressure, and wherein the angle of inclination of each of the front wall surfaces of the blades at an inner peripheral portion is larger than that of the rear wall surfaces thereof at the inner peripheral portion.

10. A turbine type fuel pump comprising:

a disc shape impeller having one and opposite side faces, the impeller being provided with blades, blade grooves, and an annular portion formed on an outer periphery side of the blade grooves, the blades and the blade grooves being formed alternately in a circumferential direction on the one and opposite side faces at an outer periphery portion of the impeller; and a pump housing which houses the impeller therein rotatably, the pump housing having generally C-shaped side grooves on one and the opposite side in communication with the blade grooves on one and the opposite side respectively, the side grooves on one and the opposite side having start end and terminal end portions on one and the opposite side respectively, a fuel suction port communicating with the start end portion on one side, and a fuel discharge port communicating with the terminal end portion on the opposite side, wherein, both front and rear wall surfaces of each of the blades are inclined backward with respect to a rotational direction thereof to make an acute angle to the respective one and the opposite side faces, wherein, by rotation of the impeller, fuel is circulated independently between the side grooves on one and the opposite side and the blade grooves on one and the opposite side to increase the fuel pressure, and wherein the angle of inclination of each of the front wall surfaces of the blades at an outer peripheral portion is larger than that of the rear wall surfaces at the outer peripheral portion, and the angle of inclination of each of the front wall surfaces of the blades at an inner peripheral portion is lager than that of the rear wall surfaces at the inner peripheral portion.

11. A turbine type fuel pump according to claim 1, wherein the blades and blade grooves on one side are formed in a circumferentially displaced state with respect to the blades and blade grooves on the opposite side.

12. A turbine type fuel pump according to claim 11, wherein each space of the blade grooves on one and the opposite side is gradually decreased toward an axially central part of the impeller from each of the side faces.

13. A disc shape impeller having one and opposite side faces, comprising:

a plurality of one-side blade grooves formed spacedly in a circumferential direction on the one side face at an outer periphery portion thereof;

a plurality of opposite-side blade grooves formed spacedly in a circumferential direction on the opposite side face at the outer periphery portion thereof and isolated from the one-side blade grooves;

a plurality of communicating holes formed to extend from the one to the opposite side face at positions each being deviated radially inwards from each of the one- and opposite-side blade grooves;

a plurality of one-side shallow grooves which extend from the plural one-side blade grooves along the one side face to axial ends of the plural communicating holes and through which the plural one-side blade grooves communicate with the plural communicating holes; and a plurality of opposite-side shallow grooves which extend from the plural opposite-side blade grooves along the opposite side face to the other axial ends of the plural communicating holes and through which the plural opposite-side blade grooves communicate with the plural communicating holes.

14. A disk shape impeller according to claim 13, wherein the plural one-side blade grooves and the plural opposite-side blade grooves are displaced from each other in the circumferential direction.

15. A disk shape impeller according to claim 13, wherein the plural communicating holes are displaced in a circumferential direction from radial extension lines of the plural one- and opposite-side blade grooves.

16. A disk shape impeller according to claim 13, wherein the number of the communicating holes is equal to or smaller than the number of the one- and opposite-side blade grooves.

17. An impeller according to claim 13, wherein each of the plural one- and opposite-side shallow grooves is displaced in a circumferential direction from a radial extension line of each of the plural one- and opposite-side blade grooves and also from a radial extension line of each of the communicating holes.

18. A turbine type fuel pump comprising:

a disc shape impeller having a one and opposite side faces, a plurality of one-side blade grooves formed spacedly in a circumferential direction on the one side face at an outer periphery portion thereof, a plurality of opposite-side blade grooves formed spacedly in a circumferential direction on the opposite side face at the outer periphery portion thereof and isolated from the one-side blade grooves, and a plurality of communicating holes formed to extend axially from the one to the opposite side face at positions each being deviated radially inwards from each of the one- and opposite-side blade grooves;

a pump housing which houses the impeller therein rotatably, the pump housing having a fuel suction port, a fuel discharge port, a generally C-shaped one-side side groove being in communication with the one-side blade grooves and a generally C-shaped opposite-side side groove being in communication with the opposite-side blade grooves, the generally C-shaped one-side side groove having a one-side start end portion and a one-side terminal end portion, the one-side start end portion being provided with a first communicating portion opposed to one-side openings of the plural communicating holes but not opposed to the one side blade grooves and being in communication with the fuel suction port, the one-side terminal end portion being provided with a second communicating portion opposed to the one-side openings but not opposed to the one side blade grooves, the generally C-shaped opposite-side side grooves having an opposite-side start end portion and an opposite-side terminal end portion, the opposite-side start end portion being provided with a third communicating portion opposed to opposite-side openings of the plural communicating holes but not opposed to the opposite side blade grooves, the opposite-side terminal end portion being provided with a fourth communicating portion opposed to the opposite-side openings but not opposed to the opposite side blade grooves and being in communication with the fuel discharge port; and a motor for rotating the impeller within the pump housing, wherein, while fuel entered into the first communicating portion from the fuel suction port flows to the third communicating portion through the communicating holes, the fuel flows from the one- and opposite-side start end portions to the one- and opposite-side terminal end portions through the one- and opposite-side grooves and blade grooves, respectively, and the fuel whose pressure has been increased in the second communicating portion flows to the fourth communicating portion through the communicating holes and is discharged from the fuel discharge port.

19. A turbine type fuel pump according to claim 18, wherein the pump housing comprises a lid shape first housing located on a side of the fuel suction port and a container shape second housing located on a side of the fuel discharge port.

20. A turbine type fuel pump according to claim 19, wherein the first and second communicating portions are formed in the first housing radially inside of the one-side start end portion and terminal end portion and have a radial length corresponding to the plural communicating holes.

21. A turbine type fuel pump according to claim 19, wherein the third and fourth communicating portions are formed in the second housing radially inside of the opposite-side start end portion and terminal end portion and have a radial length corresponding to the plural communicating holes.

22. A disc shape impeller having one and the opposite side faces, comprising:

a plurality of one-side blades and blade grooves formed alternately in a circumferential direction on the one side face at an outer periphery portion thereof;

a plurality of opposite-side blades and blade grooves formed alternately in a circumferential direction on the opposite side face at the outer periphery portion thereof, the opposite-side blade grooves being isolated from the one-side blade grooves;

an outer annular portion positioned on an outer periphery side of the one- and opposite-side blades, wherein each axial tip end of the one- and opposite-side blade grooves extends beyond an axially intermediate portion central part of the impeller.

23. A turbine type fuel pump according to claim 22, further comprising:

a pump housing which houses the impeller therein rotatably, the pump housing having generally C-shaped one- and opposite-side side grooves corresponding to the one- and opposite-side blade grooves respectively, the one- and opposite-side grooves having one- and opposite-side start end and terminal end portions, a fuel suction port communicating with the one-side start end portion, and a fuel discharge port communicating with the opposite-side terminal end portion of side groove, wherein, by rotation of the impeller, fuel is circulated between the one- and opposite-side side grooves and the one- and opposite-side blade grooves to increase the fuel pressure.

24. A disc shape impeller having one and the opposite side faces, comprising:

a plurality of one-side blades and blade grooves formed alternately in a circumferential direction on the one side face at an outer periphery portion thereof;

a plurality of opposite-side blades and blade grooves formed alternately in a circumferential direction on the opposite side face at the outer periphery portion thereof, the opposite-side blade grooves being isolated from the one-side blade grooves;

an outer annular portion positioned on an outer periphery side of the one- and opposite-side blades, wherein the one- and opposite-side blade grooves are axially overlapped each other in a section including an axis of the impeller.

25. A disk shape impeller according to claim 24, wherein front and rear wall surfaces of the one- and opposite-side blade grooves are inclined backward with respect to a rotational direction.

26. A disk shape impeller according to claim 24, wherein the one- and opposite-side blade grooves are displaced from each other in a circumferential direction.

27. A disk shape impeller according to claim 24, further comprising:

a plurality of communicating holes passing through from the one side face to the opposite side face.

28. A disk shape impeller according to claim 27, wherein the plural communicating holes are deviated in a circumferential direction from radial extension lines of the one- and opposite-side blade grooves.

29. A disk shape impeller according to claim 24, wherein the annular portion is formed with a plurality of one-side shallow grooves and a plurality of opposite-side shallow grooves to provide communication between the plural one- and opposite-side blade grooves and plural communicating holes.

30. A disk shape impeller according to claim 25, wherein the one- and opposite-side blade grooves are displaced from each other in a circumferential direction.

31. A disk shape impeller according to claim 25, wherein the annular portion is formed with a plurality of one-side shallow grooves and a plurality of opposite-side shallow grooves to provide communication between the plural one- and opposite-side blade grooves and plural communicating holes.

* * * * *